US010612181B2

(12) United States Patent
Beaudreault et al.

(10) Patent No.: US 10,612,181 B2
(45) Date of Patent: Apr. 7, 2020

(54) LAUNDRY TREATING APPLIANCE WITH DISPENSER HAVING DOMED BOTTOM

(71) Applicant: WHIRLPOOL CORPORATION, Benton Harbor, MI (US)

(72) Inventors: James J. Beaudreault, Lincoln, RI (US); Gaurav Bhardwaj, New Delhi (IN); Adam Brown, Holland, MI (US); Pushkar P. Gijare, Pune (IN); Eamon C. Lyons, Somerset, MA (US); Thibaut Viguier, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 268 days.

(21) Appl. No.: 15/486,498

(22) Filed: Apr. 13, 2017

(65) Prior Publication Data

US 2018/0298542 A1 Oct. 18, 2018

(51) Int. Cl.
*D06F 39/02* (2006.01)
*D06F 37/04* (2006.01)

(52) U.S. Cl.
CPC ..... *D06F 39/028* (2013.01); *D06F 37/04* (2013.01); *D06F 39/02* (2013.01)

(58) Field of Classification Search
None
See application file for complete search history.

(56) References Cited

U.S. PATENT DOCUMENTS

| | | | | |
|---|---|---|---|---|
| 2,643,537 | A | 6/1953 | Woodson | |
| 2,976,879 | A | 3/1961 | De Lisle et al. | |
| 3,406,876 | A | 10/1968 | Steele et al. | |
| 3,975,931 | A | 8/1976 | Bischkopf | |
| 4,759,202 | A | 7/1988 | Caron | |
| 5,473,914 | A | 12/1995 | Pyo et al. | |
| 5,483,989 | A | 1/1996 | Lim | |
| 5,685,178 | A | 11/1997 | Ann | |
| 8,074,476 | B2 * | 12/2011 | Quandt | D06F 39/02 68/17 R |
| 8,206,512 | B2 | 6/2012 | Gnadinger et al. | |
| 9,003,588 | B2 | 4/2015 | Amos et al. | |
| 2003/0145633 | A1 | 8/2003 | Merkle et al. | |
| 2007/0163307 | A1 * | 7/2007 | Kramme | D06F 39/02 68/17 R |
| 2008/0295546 | A1 | 12/2008 | Cho et al. | |
| 2009/0158782 | A1 | 6/2009 | Hill | |
| 2010/0018258 | A1 | 1/2010 | Cho et al. | |

(Continued)

FOREIGN PATENT DOCUMENTS

| | | | |
|---|---|---|---|
| CH | 450340 | A | 1/1968 |
| EP | 0099798 | A1 | 2/1984 |

(Continued)

*Primary Examiner* — Cristi J Tate-Sims
(74) *Attorney, Agent, or Firm* — McGarry Bair PC

(57) ABSTRACT

A laundry treating appliance includes a cabinet, a treating chamber, and a treating chemistry dispenser provided with the cabinet and fluidly coupled to the treating chamber. The dispenser includes at least one dispenser pocket having a domed bottom and a side wall extending upwardly from the domed bottom. A plurality of outlets for a water/chemistry mixture can be defined between the domed bottom and the side wall. An angled inlet duct can project into the dispenser pocket in opposition to the domed bottom.

20 Claims, 19 Drawing Sheets

(56) References Cited

U.S. PATENT DOCUMENTS

| | | | | |
|---|---|---|---|---|
| 2012/0125055 | A1 | 5/2012 | Lee | |
| 2014/0190220 | A1 | 7/2014 | Lee et al. | |
| 2015/0143856 | A1 | 5/2015 | Jo et al. | |
| 2015/0143857 | A1* | 5/2015 | Jo | D06F 39/02 68/17 R |
| 2015/0159313 | A1 | 6/2015 | Amos et al. | |
| 2015/0259846 | A1 | 9/2015 | Salomonsson | |

FOREIGN PATENT DOCUMENTS

| | | | | |
|---|---|---|---|---|
| EP | 0244900 | A2 | 11/1987 | |
| EP | 2460925 | A1 | 6/2012 | |
| FR | 2505374 | A1 | 11/1982 | |
| GB | 2157716 | A * | 10/1985 | D06F 39/02 |

* cited by examiner

62

62

LAUNDRY TREATING APPLIANCE WITH DISPENSER HAVING DOMED BOTTOM

BACKGROUND

Laundry treating appliances, such as clothes washers or washing machines, typically include a dispensing system for storing and dispensing treating chemistry to a treating chamber of the washing machine for use in treating the laundry according to a cycle of operation. The dispensing system may include a dispenser configured to dispense one or more treating chemistries into the treating chamber. The treating chemistry may be mixed with water before or while being introduced to the treating chamber. Some dispensers are configured to dispense multiple treating chemistries during different portions of the cycle, including a pre-wash detergent, a main-wash detergent, bleach, and fabric softener. Detergents are available in liquid or powder forms, and some dispensers allow for either type of detergent to be used.

Various examples of dispensing structures have been previously proposed. For example, U.S. Pat. No. 2,976,879 generally discloses a rinse aid dispenser for a washing machine including a supply conduit terminating in a nozzle which directs liquid across the floor of the dispenser to flush rinse aid into the tank. The conduit is assembled with the dispenser by sliding an annular groove on the nozzle down into a slot which terminates in a rounded opening to hold the conduit in place. European Publication No. EP0244900 discloses a detergent drawer structure for use on washing machines that includes a casing provided with a base aperture for discharge into the washing machine tub, a slidable body divided into compartments for receiving detergents, and structures for feeding water into the compartments. U.S. Pat. No. 2,643,537 discloses a dispenser for a washing machine with a chamber having an elbow portion or trap leading to an outlet to the tub. The chamber can be filled with powder detergent via a funnel closed by a hinged cap and will arrange itself in a pile remote from the trap. European Publication No. EP2460925 generally discloses a detergent dispenser structure having hopper rings, external collars, labyrinth paths, inner covers with borders on adjustages, and other structures. French publication FR2505374 generally discloses a dispenser with a container defining four compartments. An insert in the container delimits two outer compartments intended to contain powder, with the two inner compartments in the insert intended to contain liquid. Each liquid compartment is provided with a siphon. U.S. Pat. No. 8,074,476 discloses a washing machine having a dispenser for directing chemical additives, including a siphoning device having a water inlet, an upstanding siphoning tube, a cover, and a chemical additive receptacle about the siphoning tube, among other structures. U.S. Pat. No. 9,003,588 generally discloses a method for treating fabric where a liquid stream is introduced into a dispensing cup from a position above the cup and beyond a periphery of a cover over a siphon tube in the cup, with the liquid stream travelling downwardly along a trajectory terminating below and within the periphery of the cover, where the liquid stream impinges a portion of at least one of the cup and siphon tube below the cover. Still other prior exemplary disclosures include European Publication No. EP0099798 and U.S. Pat. No. 5,685,178.

However, these and other available dispenser designs suffer in numerous respects. For example, prior solutions may suffer from poor water distribution, which impacts clothes cleaning performance. Prior solutions also suffer in their ability to clean out chemistry from the dispenser structure, which over time impacts clothes cleaning performance. Moreover, residue inside the dispenser negatively impacts customer perceptions of the dispenser. Existing dispensers also lack features that easily distinguish differentiate chambers for a user, which negatively impacts usability.

BRIEF SUMMARY

In contrast to the above-summarized prior art solutions, one aspect of the disclosure relates to a treating chemistry dispenser for a laundry treating appliance, the treating chemistry dispenser including at least one dispenser pocket having a domed bottom, a side wall extending upwardly from the domed bottom, and a plurality of outlets defined between the domed base wall and the side wall.

Another aspect of the disclosure relates to a treating chemistry dispenser for a laundry treating appliance, the treating chemistry dispenser including at least one dispenser pocket having a domed bottom, a side wall extending upwardly from the domed bottom, and an angled inlet duct projecting into the at least one dispenser pocket and having an outlet in opposition to the domed bottom.

DETAILED DESCRIPTION

Systems, components, and methodologies in accordance with the present disclosure enable a laundry treating appliance to dispense treating chemistry. The present disclosure provides a dispenser for dispensing multiple treating chemistries, including both liquid and powder chemistries. Aspects of the systems, components, and methodologies described herein may also be applicable to dispensers that dispenser only liquid chemistries or only powder chemistries.

The dispenser is described herein in relation to a laundry treating appliance in the form of a washing machine for treating fabric articles according to a cycle of operation. The washing machine may be a household or commercial appliance. It should be appreciated, however, that the dispenser as described herein is not so limited and can have equal applicability to additional appliances, such as any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

Figure 1:
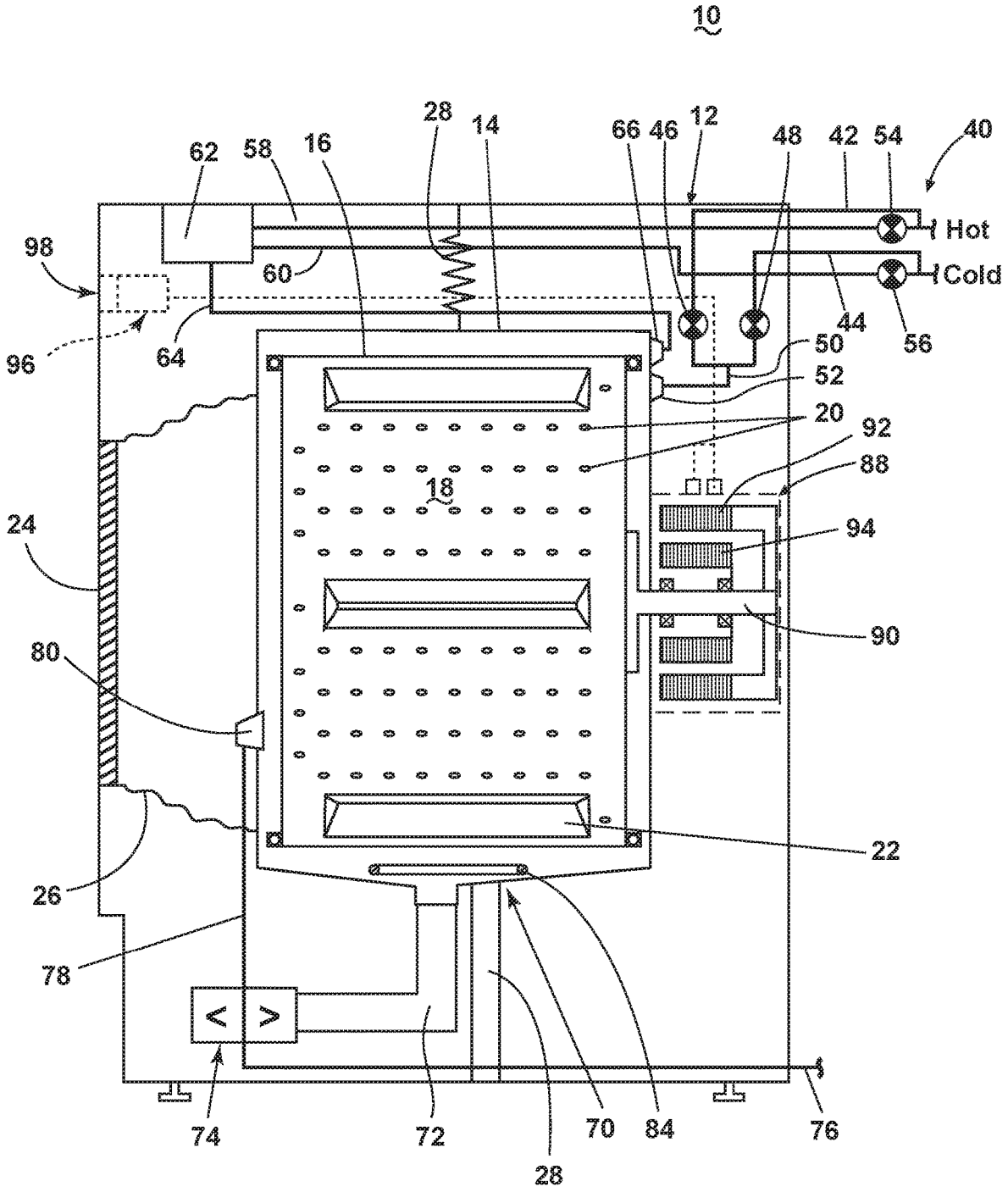
FIG. 1 is a schematic view of a laundry treating appliance in the form of a washing machine according to one embodiment of the present disclosure.

FIG. 1 is a schematic view of a laundry treating appliance according to one embodiment of the present disclosure. The laundry treating appliance of FIG. 1 is illustrated as a washing machine 10, which may include a structural support system comprising a chassis or cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the disclosure.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the disclosure for the laundry holding system to comprise only a tub with the tub defining the laundry treating chamber.

The laundry holding system may further include a door 24 which may be movably mounted to the cabinet 12 to selectively close both the tub 14 and the drum 16 at an access opening 25. A bellows 26 may couple the access opening 25 of the tub 14 with the cabinet 12, with the door 24 sealing against the bellows 26 when the door 24 closes the tub 14. Alternatively, a bellows may not be included, and the door 24 can seal directly against the tub 14 when closed.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household or commercial water supply 40, which may include separate hot and cold water supplies. Hot and cold water may be supplied through inlet conduits 42, 44, respectively, directly to the tub 14 by controlling hot and cold water supply valves 46 and 48, respectively. The valves 46, 48 may direct the flow of liquid to a tub outlet conduit 50 which may be provided with a spray nozzle 52 configured to spray the flow of liquid into the tub 14. In this manner, water from the water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a treating chemistry dispenser 62, described in further detail below. The dispenser 62 may be configured to dispense one or more treating chemistries directly to the tub 14 or one or more treating chemistries mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream.

Valves 54, 56 control the flow of hot and cold water, respectively to the dispenser 62. Water may be supplied to the dispenser 62 from the water supply 40 opening one or both of the valves 54, 56 to direct the flow of water to dispensing supply conduits 58, 60, respectively. One hot and one cold dispensing supply conduit 58, 60 is shown in FIG. 1 for illustrative purposes, but it understood that multiple hot and cold dispensing supply conduits 58, 60 may fluidly couple with the dispenser 62 to supply hot and/or cold water to different compartments of the dispenser. Furthermore, while the dispensing system is shown as filling the tub 14 at the rear of the machine 10, alternatively the dispensing system can fill the tub 14 at the front of the machine 10.

Non-limiting examples of treating chemistries that may be dispensed by the dispensing system during a cycle of operation include one or more of the following: water, liquid detergents, powder detergents, fabric softeners, bleach, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 50 and/or the dispensing outlet conduit 64 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may optionally be provided with a heating system which may include one or more devices for heating laundry and/or liquid supplied to the tub 14, such as a steam generator 82 (FIG. 2) and/or a sump heater 84. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
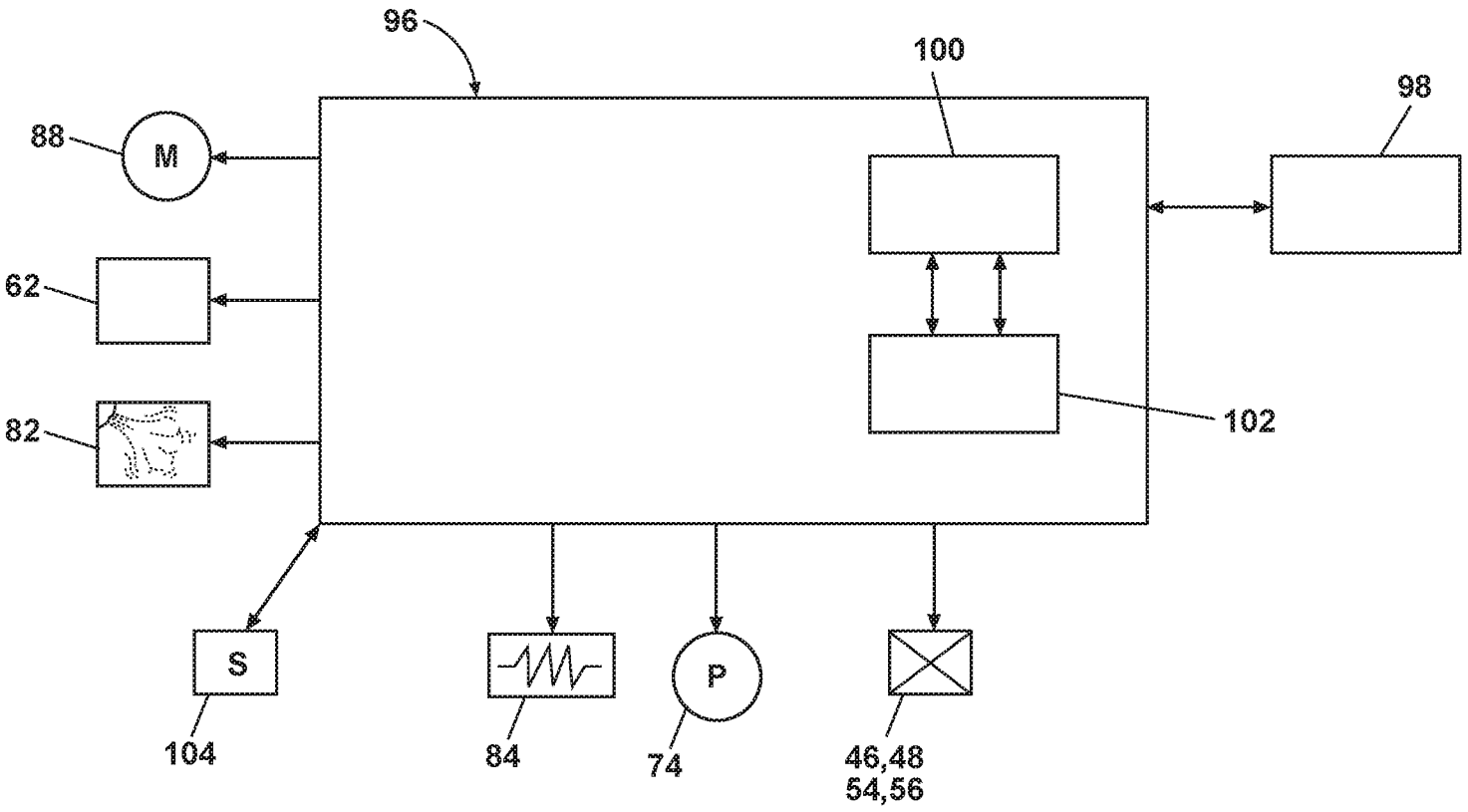
FIG. 2 is a schematic of a control system of the laundry treating appliance of FIG. 1.

FIG. 2 is a schematic of a control system of the laundry treating appliance of FIG. 1. The controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and/or the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a load amount sensor, a chemical sensor, a position sensor and a motor torque sensor, which may be used to determine a variety of system and laundry characteristics, such as laundry load inertia or mass.

Figure 3:
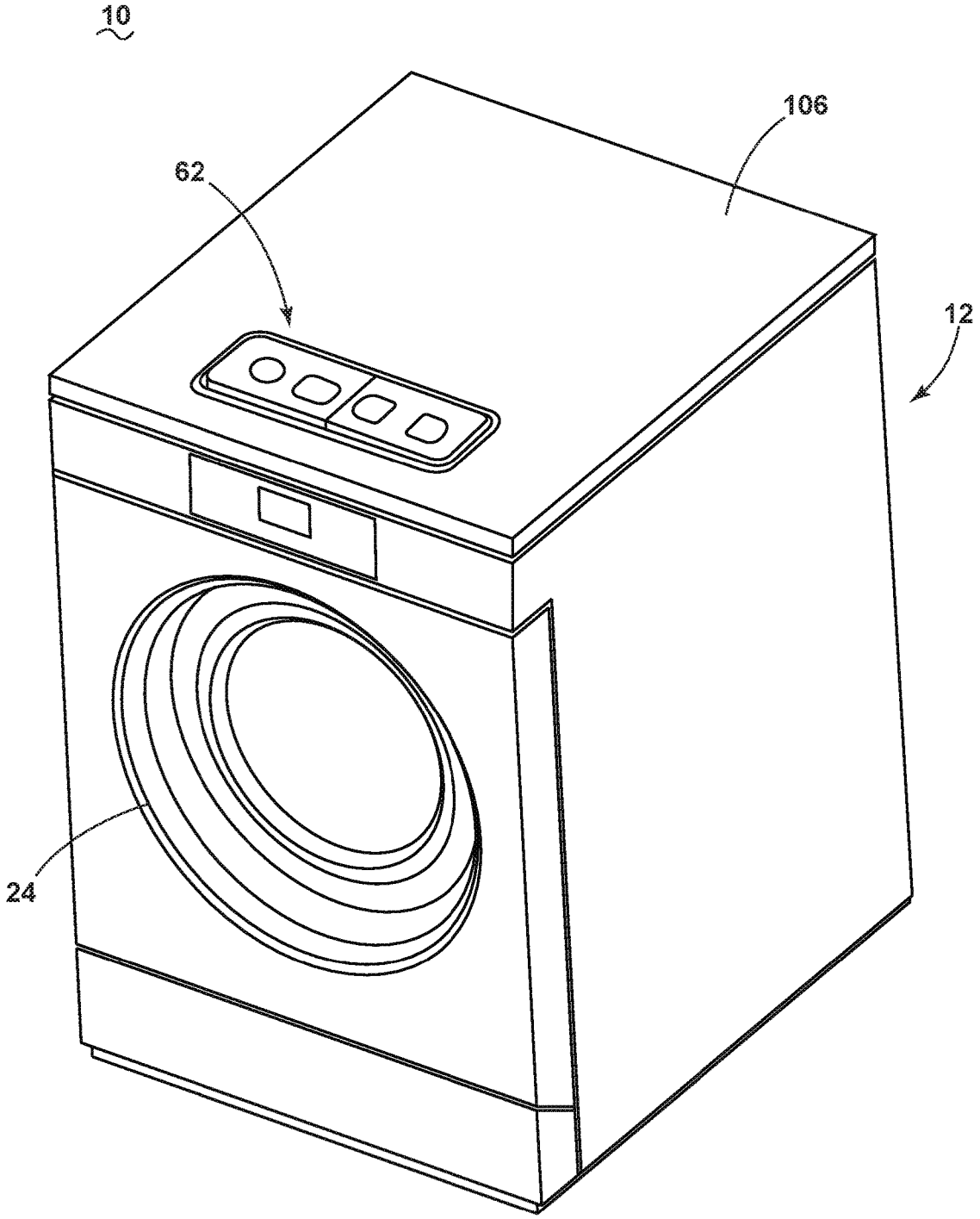
FIG. 3 is a perspective view of one example of a washing machine in which a dispenser may be provided.

FIG. 3 is a perspective view of one example of the washing machine 10 in which the treating chemistry dispenser 62 can be provided. The dispenser 62 is shown in a horizontal-axis commercial washing machine 10, but may also be used in other types of washing machines, including those for home or residential use. The dispenser 62 may be provided on a top surface or wall 106 of the cabinet 12, closer to the front of the cabinet 12 so that a user may access the dispenser 62 from the front of the machine 10.

Figure 4:
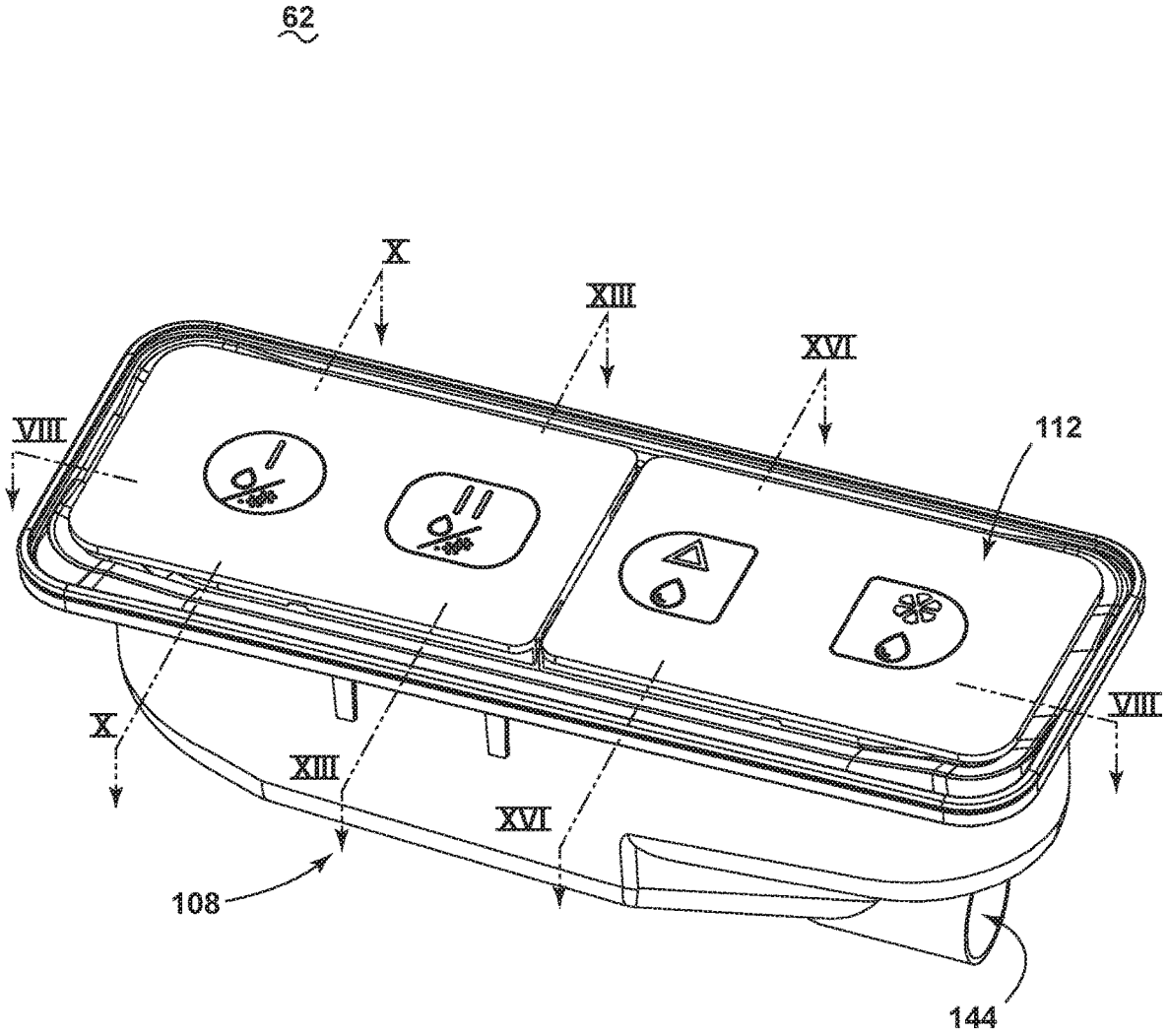
FIG. 4 is a front perspective view of a dispenser for a washing machine.

Referring now to FIG. 4, one embodiment of the dispenser 62 is illustrated. The dispenser 62 includes a dispenser container 108 and a dispenser cover 112 closing an open top of the dispenser container 108. The dispenser container 108 can include multiple compartments or pockets for receiving one or more treating chemistries.

Figure 5:
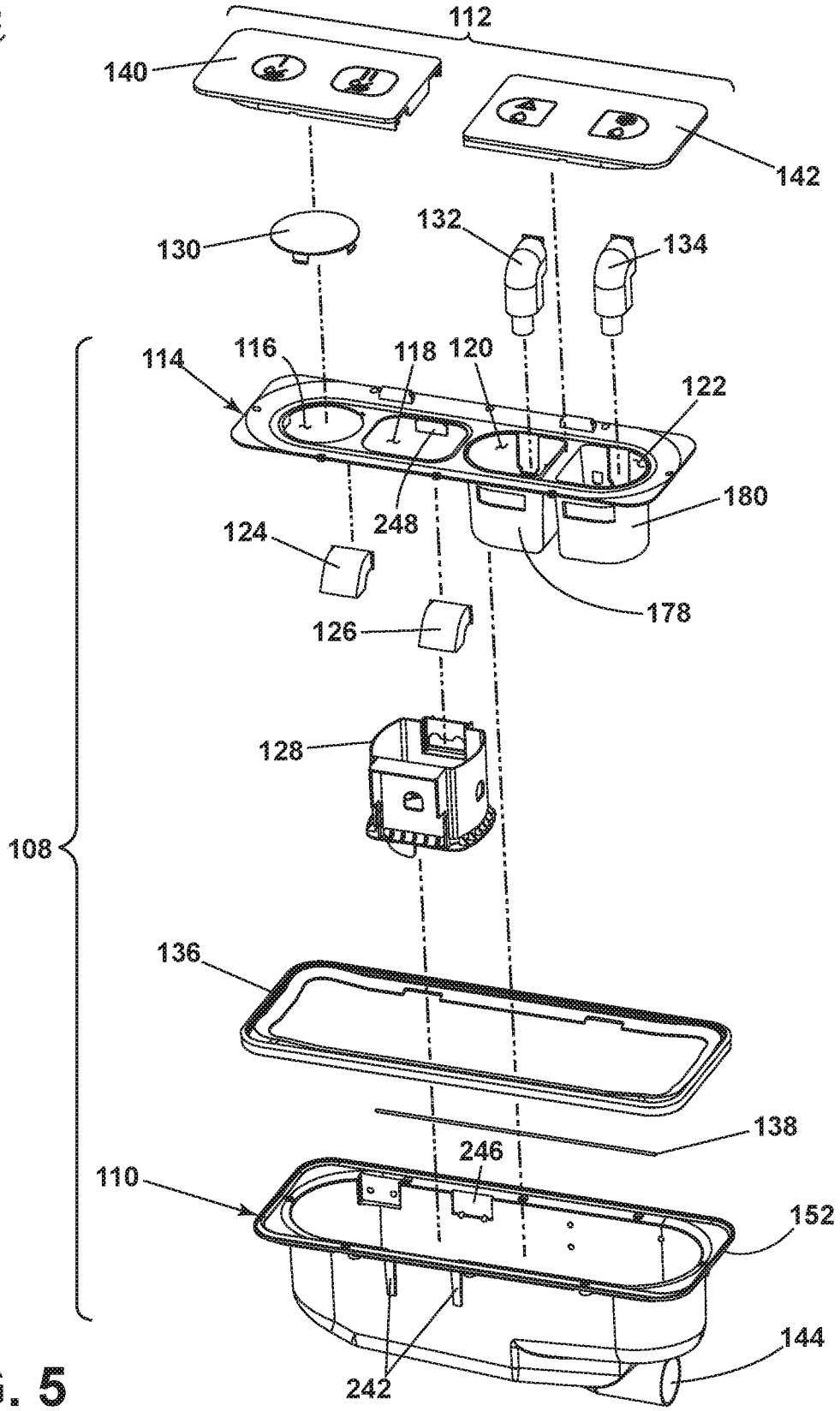
FIG. 5 is an exploded view of the dispenser from FIG. 4.

FIG. 5 is an exploded view of the dispenser 62 from FIG. 4. The dispenser container 108 can include a one- or multiple-piece body that defines multiple compartments or pockets for various treating chemistries. In the illustrated embodiment, the dispensing container 108 includes an outer container housing 110 and a container partition insert 114 received by the housing 110 and that generally divides the housing 110 into four compartments or pockets for various treating chemistries. The pockets can include a pre-wash pocket 116, a main-wash pocket 118, a bleach pocket 120, and fabric softener pocket 122. Each pocket 116-122 can be sized to receive a single dose of treating chemistry for one cycle of operation of the washing machine 10. The dispenser 62 further includes water inlet ducts 124, 126 for the pre-wash and main-wash pockets 116, 118, a main-wash insert 128 for the main-wash pocket 118, an optional cover 130 for the pre-wash pocket 116, siphons 132, 134 for the bleach and fabric softener pockets 120, 122, and a seal 136.

The housing 110 provides an enclosure for the dispenser 62 and can isolate the components of the dispenser 62 from other parts of the washing machine 10. The housing 110 directs incoming water to one or more of the pockets 116-122, and channels the outgoing chemistry and water mixtures to an outlet 144 in fluid communication with the treating chamber 18 (FIG. 1) via the dispensing outlet conduit 64. The housing 110 illustrated has a generally rectangular shape, with the pockets 116-122 arranged in juxtaposition or side-by-side, in a single row within the housing 110, although other shapes and pocket arrangements are possible.

The seal 136 acts as a sealing member between the dispenser container 108 and the cabinet 12 of the washing machine 10 (see FIG. 3). The seal 136 also prevents water leakage from the housing 110. The seal 136 can have an interference fit with the housing 110 and can have an overall shape that matches the shape of the housing 110.

The dispenser cover 112 can be coupled with the dispenser container 108 by a hinge pin 138, and may further be split into multiple sections for covering one or more of the pockets 116-122. As shown, the dispenser cover 112 includes two section lids 140, 142 and can have an overall shape that matches the shape of the dispenser housing 110. The dispenser cover 112 is specifically coupled directly with the partition insert 114 received by the dispenser housing 110 by the hinge pin 138 in the illustrated embodiment. Alternatively, the dispenser cover 112 can be coupled directly with the housing 110.

Figure 6:
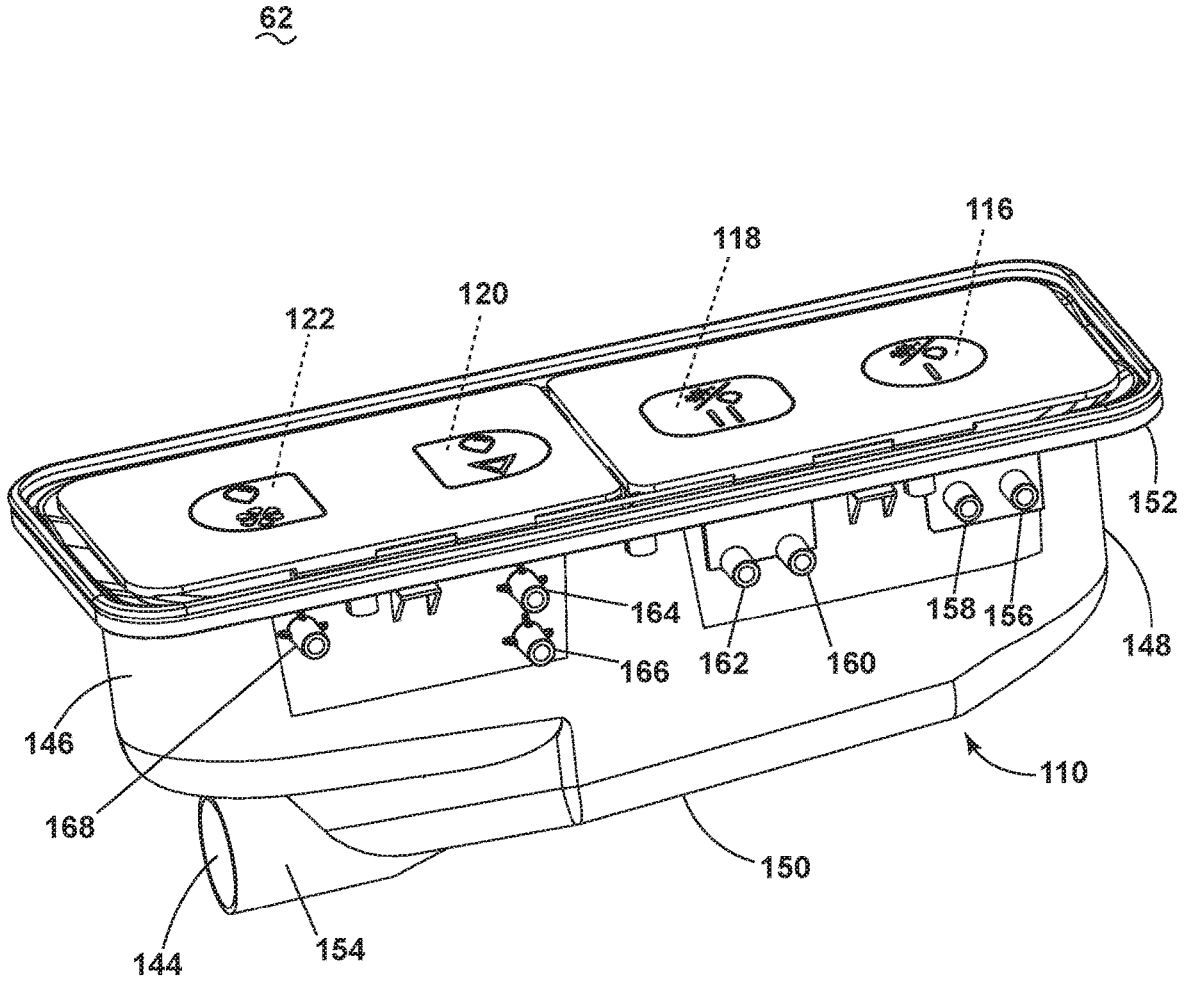
FIG. 6 is a rear perspective view of the dispenser from FIG. 4.

With additional reference to FIG. 6, which is a rear perspective view of the dispenser 62, the housing 110 includes an open-topped container body 146 having a peripheral side wall 148, a bottom wall 150, and a lip 152 extending outwardly from the upper side of the peripheral side wall 148 at the open top. The lip 152 can be used in fixing the housing 110 to the washing machine cabinet. The bottom wall 150 is channelized to direct the outgoing chemistry and water mixtures toward an outlet conduit 154 which defines the outlet 144. The outlet conduit 154 interfaces with the dispensing outlet conduit 64 (FIG. 1), which may include a fill hose in fluid communication with the treating chamber 18 of the washing machine 10.

One or more water inlets are provided in the container body 146 for supplying water to the housing 110. The water inlets can be provided in the sidewall 148 of the container body 146, and aligned with one of the pockets 116-122. At least one water inlet can be provided for each pocket 116-122, and as shown herein multiple inlets may be provided for one pocket 116-122 to interface with separate hoses in fluid communication with the hot and cold inlet valves 54, 56 (FIG. 1). As shown, a hot water inlet 156 and a cold water inlet 158 is provided for the pre-wash pocket 116, a hot water inlet 160 and a cold water inlet 162 is provided for the main-wash pocket 118, a hot water inlet 164 and a cold water inlet 166 is provided for the bleach pocket 120, and a single water inlet 168 that may be coupled with the hot or cold water supply is provided for the fabric softener pocket 122.

Figure 7:
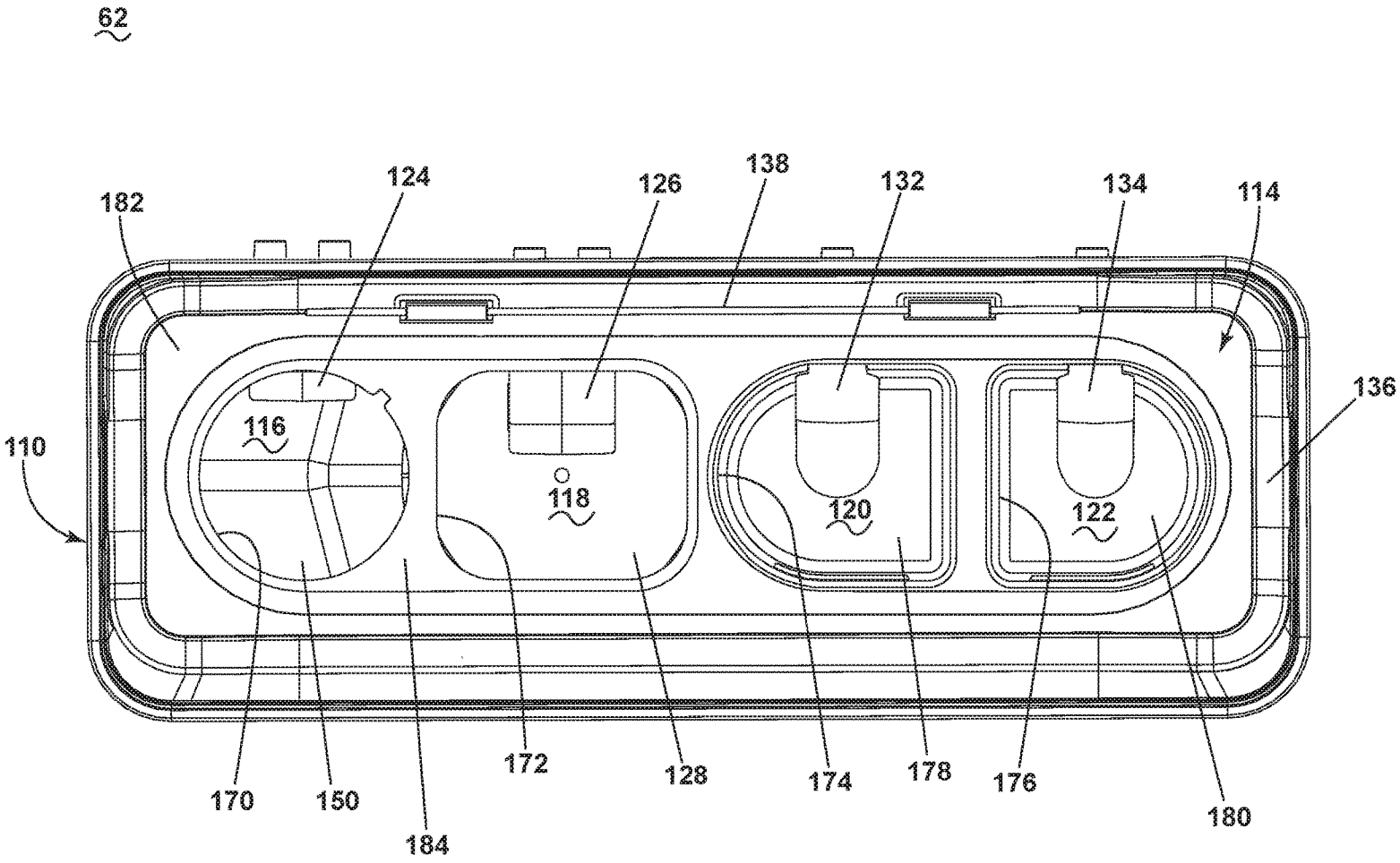
FIG. 7 is a top view of the dispenser from FIG. 4, with a cover of the dispenser removed for clarity.

FIG. 7 is a top view of the dispenser 62 with the cover 112 removed for clarity. The partition insert 114 has multiple loading openings 170-176 which differentiate the interior volume of the housing 110 into different sections corresponding to the pockets 116-122. Loading openings 170, 172 for the pre-wash and main-wash pockets 116, 118, respectively, are formed in the partition insert 114, while pocket bodies 178, 180 for the bleach and fabric softener pockets 120, 122, respectively, are formed with the partition insert 114 itself and aligned with their respective loading openings 174, 176.

The partition insert 114 can have a flange 182 which supports the partition insert 114 within the housing 110. The loading openings 170-176 and pocket bodies 178, 180 may be integrally formed with the flange 182, and the flange 182 can include a recessed area 184 in which the loading openings 170-176 are provided, which allows the loading openings 170-176 to sit below the lip 152 of the housing 110. As illustrated, the flange 182 can have a generally rectangular shape to match the generally rectangular shape of the housing 110. In addition to defining the loading openings 170-176 and forming pocket bodies 178, 180, the partition insert 114 can also act as a holding member for the water inlet ducts 124, 126, the main-wash insert 128, and the siphons 132, 134.

The loading openings 170-176 in the partition insert 114 are designed to allow for easy loading of chemistry into the pockets 116-122 to improve usability. Each loading opening 170-176 is sized to receive a dose of chemistry poured therethrough, and each loading opening 170-176 can have a distinct shape to differentiate between the different pockets 116-122. In the embodiment illustrated herein, the pre-wash pocket 116 can have a circular loading opening 170, the main-wash pocket 118 can have a rectangular loading opening 172, the bleach pocket 120 can have a left-facing D-shaped loading opening 174, and the fabric softener pocket 122 can have a right-facing D-shaped loading opening 176. By having distinctly-shaped loading openings 170-176, a user may be less likely to load a treating chemistry into an incorrect pocket 116-122.

Figure 8:
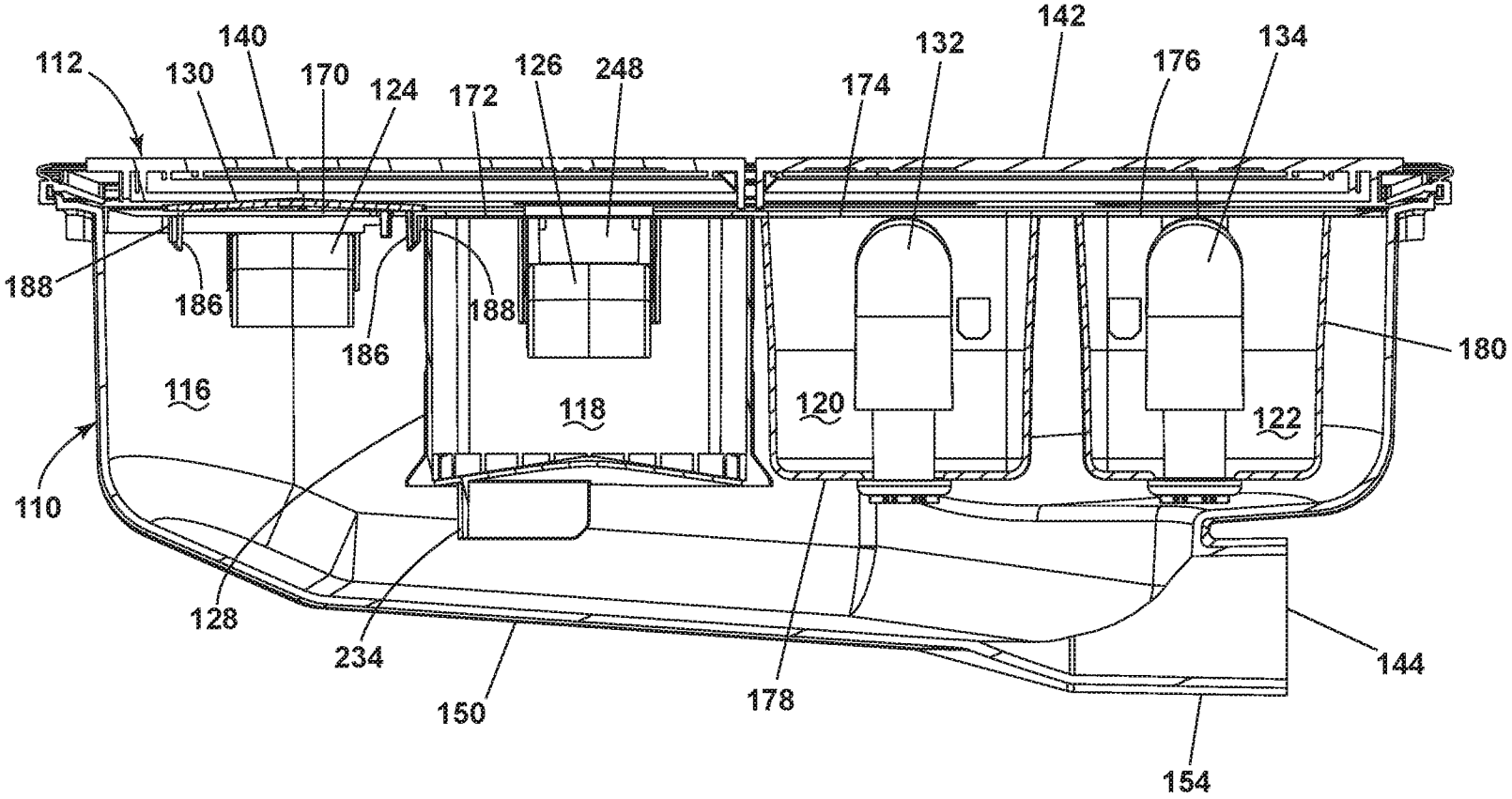
FIG. 8 is a sectional view of the dispenser, taken through line VIII-VIII of FIG. 4.

FIG. 8 is a sectional view of the dispenser 62, taken through line VIII-VIII of FIG. 4. The dispenser housing 110 itself forms the receptacle for treating chemistry loaded into the pre-wash pocket 116, with treating chemistry loaded through the loading opening 170 falling to the bottom wall 150 of the housing 110. The main-wash insert 128 forms the receptacle for treating chemistry loaded into the main-wash pocket 118 through the loading opening 172. The pocket bodies 178, 180 form the receptacles for treating chemistry loaded into the bleach and fabric softener pockets 120, 122, respectively, through the loading openings 174, 176. All outgoing chemistry and water mixtures reach the bottom wall 150 of the housing 110, which directs the mixtures toward the outlet conduit 154 which defines the outlet 144. The bottom wall 150 can be angled toward the outlet 144 so that the mixtures flow by gravity to the outlet 144.

As shown in FIG. 8, the pocket cover 130 can be provided for one of more of the pockets 116-122 to prevent a user from loading chemistry into one of more of the pockets 116-122. In the illustrated embodiment, the pocket cover 130 is provided for the pre-wash pocket 116 and selectively covers the loading opening 170 so that chemistry cannot be loaded into the pre-wash pocket 116. The pocket cover 130 can have a snap-type interface with the partition insert 114, with resilient tabs 186 on the periphery of the pocket cover 130 being received under an edge 188 of the loading opening 170. The snap interface is design in such a way that the pocket cover 130 cannot be removed without removing or disassembling the entire partition insert 114 from the housing 110.

Figure 9:
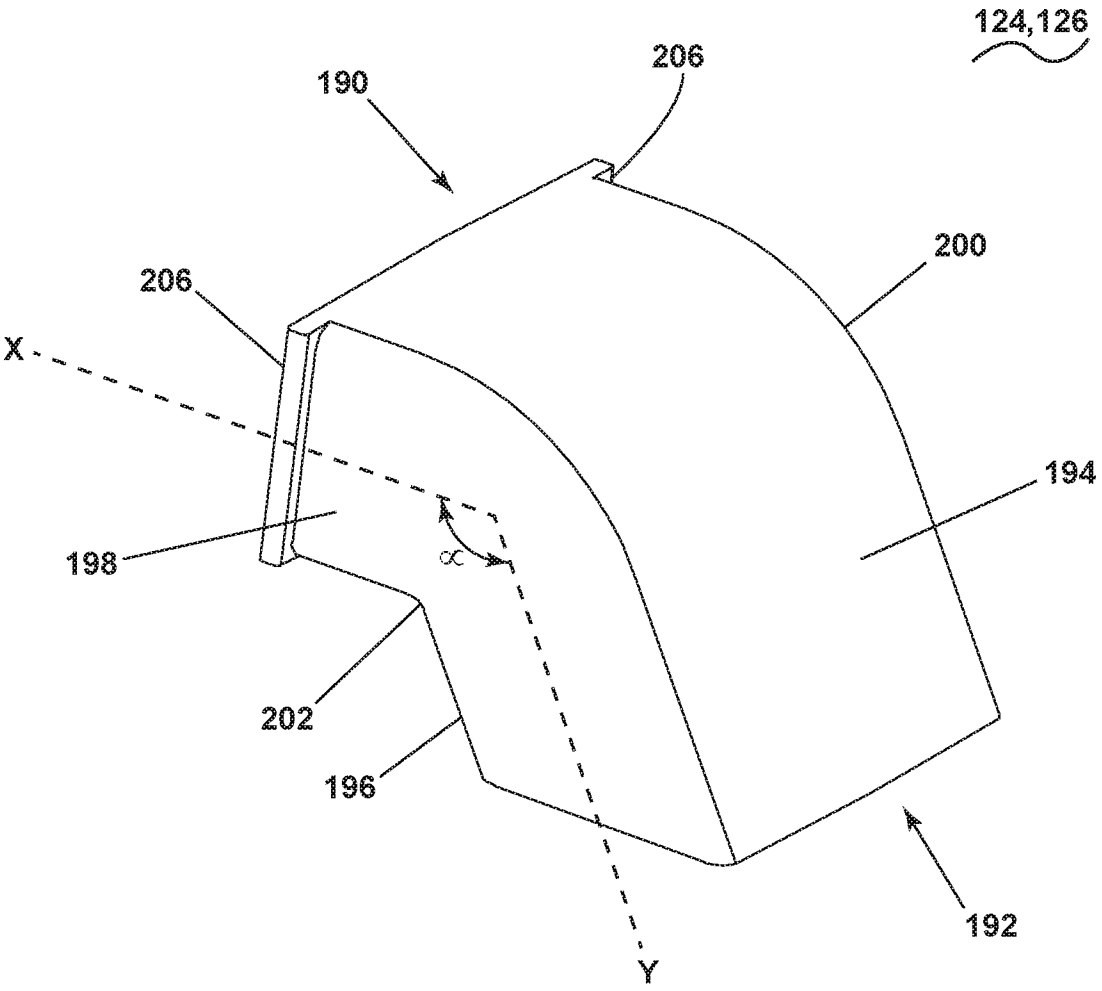
FIG. 9 is a perspective view of one embodiment of a water inlet duct of the dispenser.

FIG. 9 is a perspective view of one embodiment of the water inlet ducts 124, 126. The water inlet ducts 124, 126 can be identical, and includes a water inlet end 190 which is in fluid communication with the water supply 40 (FIG. 1) to receive water, and a water outlet end 192. As illustrated, the water inlet duct 124 is rectilinear in shape, with a top wall 194 and a bottom wall 196 joined by two side walls 198.

The inlet end 190 can define an inlet axis X, which is the linear axis extending through the centroid of the inlet opening defined by the inlet end 190. Likewise, the outlet end 192 can define an outlet axis Y, which is the linear axis extending through the centroid of the outlet opening defined by the outlet end 192. In some embodiments, the inlet and outlet axes X, Y may be collinear. In other embodiments, such as the embodiment illustrated herein, the inlet and outlet axes X, Y intersect at a non-zero angle, such that the water inlet duct 124 is angled between the inlet end 190 and the outlet end 192. In the illustrated embodiment, the water inlet duct is angled such that the top wall 194 is forward of the bottom wall 196 at the outlet end 192, where the forward direction is defined relative to the inlet end 190 or flow direction of water. The water inlet duct 124 can have a sharp transition or a curve in the top and bottom walls 194, 196 to form the angle. In the illustrated embodiment, the top wall 194 has a curve 200 and the bottom wall 196 has a sharp transition 202. In one non-limiting example, the angle $\alpha$ between the inlet and outlet axes X, Y of the water inlet duct 124 can be approximately 120°.

Figure 10:
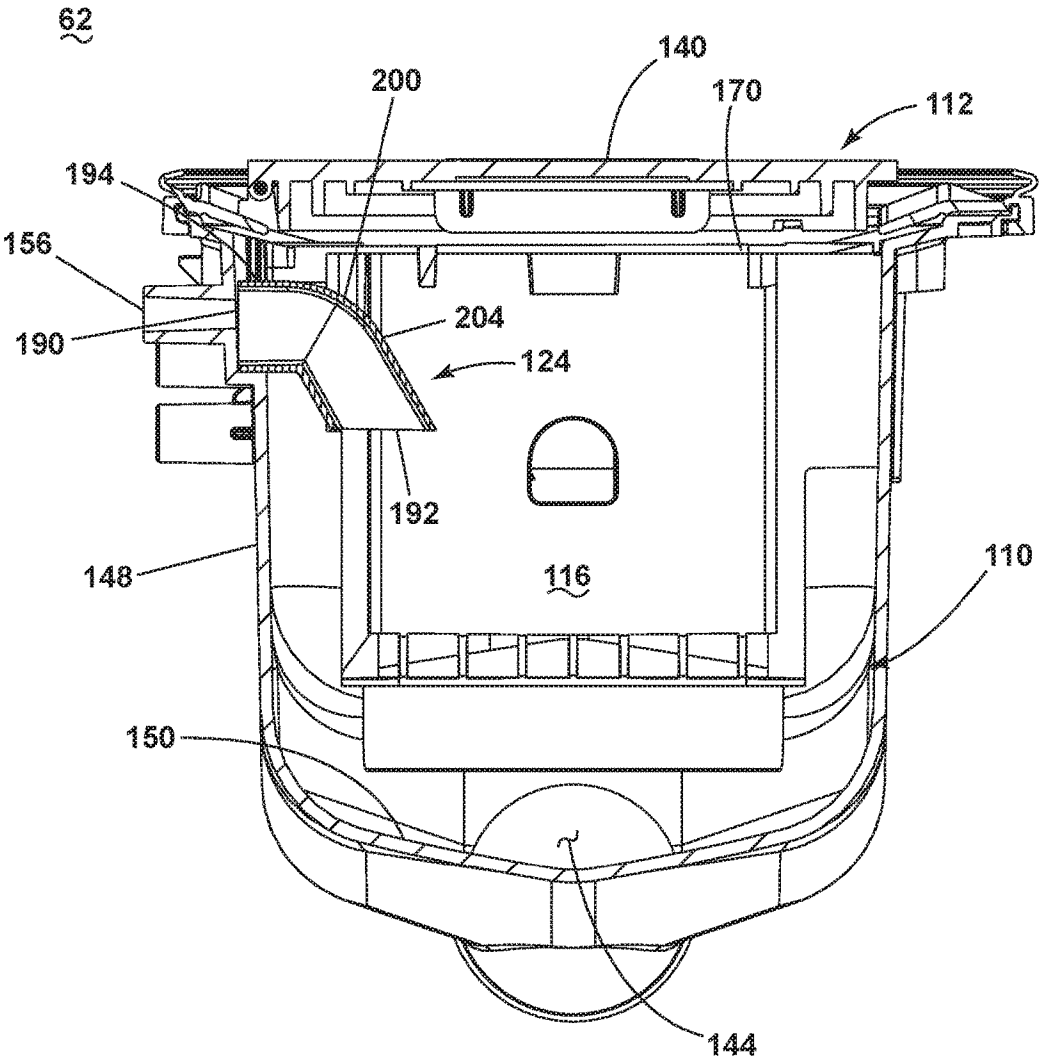
FIG. 10 is a sectional view taken along line X-X of FIG. 4, showing the flow path through a pre-wash pocket of the dispenser.

FIG. 10 is a sectional view of the pre-wash pocket 116 of the dispenser 62, taken through line X-X of FIG. 4. In the illustrated embodiment, the water inlet end 190 of the water inlet duct 124 is provided on the peripheral side wall 148 of the dispenser housing 110 in alignment with the hot and cold water inlets 156, 158, and the water outlet end 192 projects into the interior of the pocket 116. The pre-wash pocket 116 has an open bottom, and the water outlet end 192 can be spaced from and faces the bottom wall 150 of the housing 110 to dispense water toward the bottom wall 150. The flow path for dispensing treating chemistry from the pre-wash pocket 116 extends from the inlet end 190, through the inlet duct 124, along the bottom wall 150 of the dispenser container, and to the dispenser outlet 144.

The angle of the water inlet duct 124 can selected to achieve a complete cleanout of the pocket 116, and is configured to direct water into all areas of the pocket 116 to flush the treating chemistry effectively and completely. As noted above, the housing 110 itself forms the receptacle for treating chemistry loaded into the pre-wash pocket 116, with treating chemistry loaded through the loading opening 170 falling to the bottom wall 150 of the housing 110. The outlet end 192 can be provided in opposition to the bottom wall 150 so that water from the inlet duct 124 is directed at the bottom wall 150 to flush treating chemistry toward the dispenser outlet 144. An angled portion 204 of the top wall 194 that extends beyond the curve 200 can be positioned in opposition to the water inlet end 190, which avoids water backflow after the water entering the inlet end 190 strikes against the angled portion 204 of the wall 194. Instead, water is directed downwardly to the outlet end 192.

Also in the illustrated embodiment, the inlet duct 124 can be positioned below the partition insert 114, such that the inlet duct 124 is below the loading opening 170 for the pocket 116. The angle of the inlet duct 124 can further discourage treating chemistry loaded into the pocket 116 from collecting on the inlet duct 124.

In operation, treating chemistry is poured into the pocket 116 and falls to the bottom wall 150 of the housing 110. During a cycle of operation, water is supplied to the pocket 116 via the hot and/or cold inlets 156, 158. The incoming stream of water is directed downwardly toward the bottom wall 150 of the housing 110 by the inlet duct 124 to mix with the treating chemistry. The mixture of treating chemistry and water flows along the bottom wall 150 toward the dispenser outlet 144.

Figure 11:
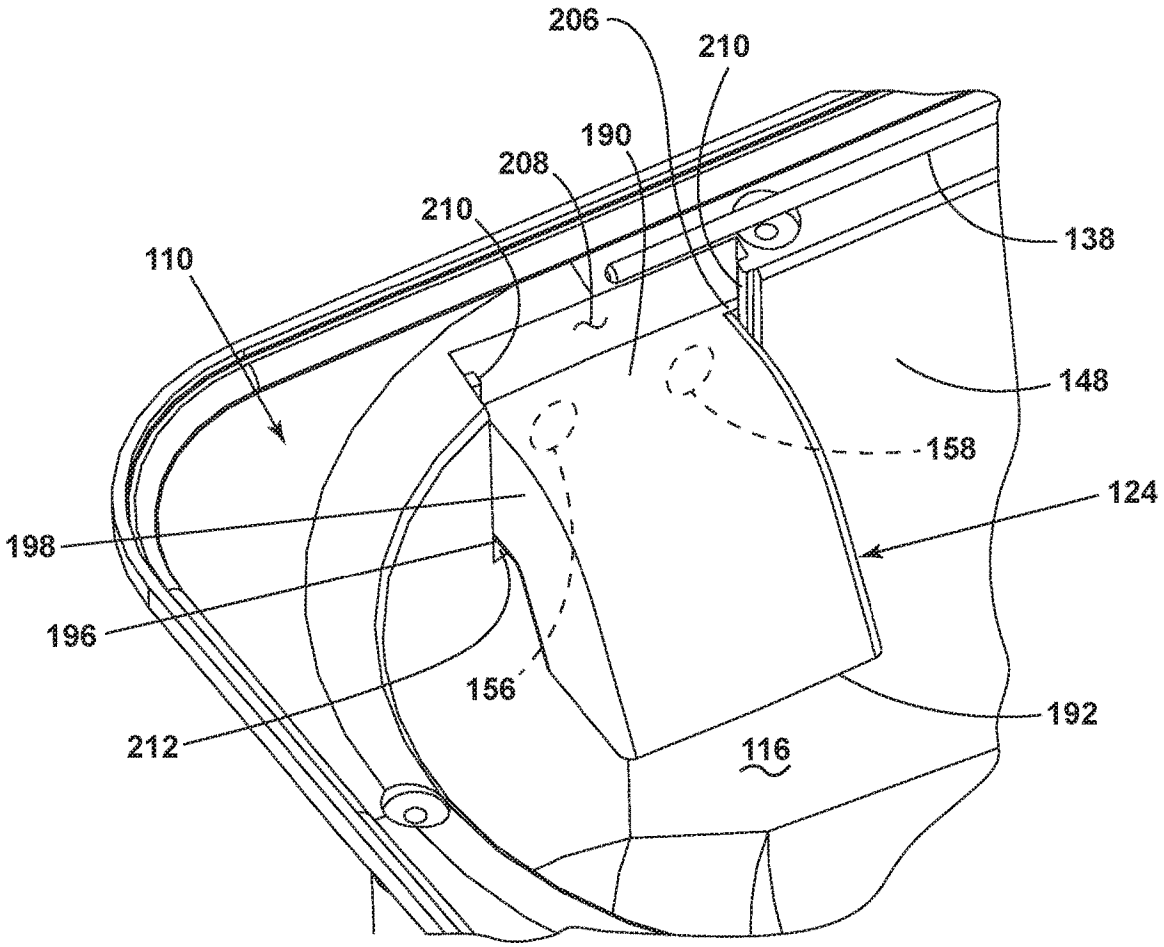
FIG. 11 is a close up view of an interface between the water inlet duct of the pre-wash pocket and the dispenser.

FIG. 11 is a close up view of an interface between the water inlet duct 124 and the dispenser housing 110. The water inlet duct 124 can be slidingly coupled with the dispenser housing 110 by a sliding interface. In the illustrated embodiment, the water inlet end 190 is slidingly coupled with the peripheral side wall 148 of the housing 110. The sliding interface can be provided as rails 206 projecting from the water inlet end 190 of the water inlet duct 124 and a track 208 configured to receive the rails 206 provided on the peripheral side wall 148 of the housing 110. Alternatively, the rails 206 can be provided on the housing 110, and the track 208 can be provided on the water inlet duct 124. Other configurations for the sliding interface are also possible.

In the illustrated embodiment, rails 206 project from the side walls 198 of the water inlet duct 124. The rails 206 are received within the track 208 and held behind ribs 210 on the sides of the track 208. The bottom wall 196 of the inlet duct 124 rests on a bottom wall 212 of the track 208. The hot and cold water inlets 156, 158 are aligned with the track 208 to fluidly couple with the inlet end 190 of the inlet duct 124 when the inlet duct 124 is physically coupled with the dispenser housing 110.

Figure 12:
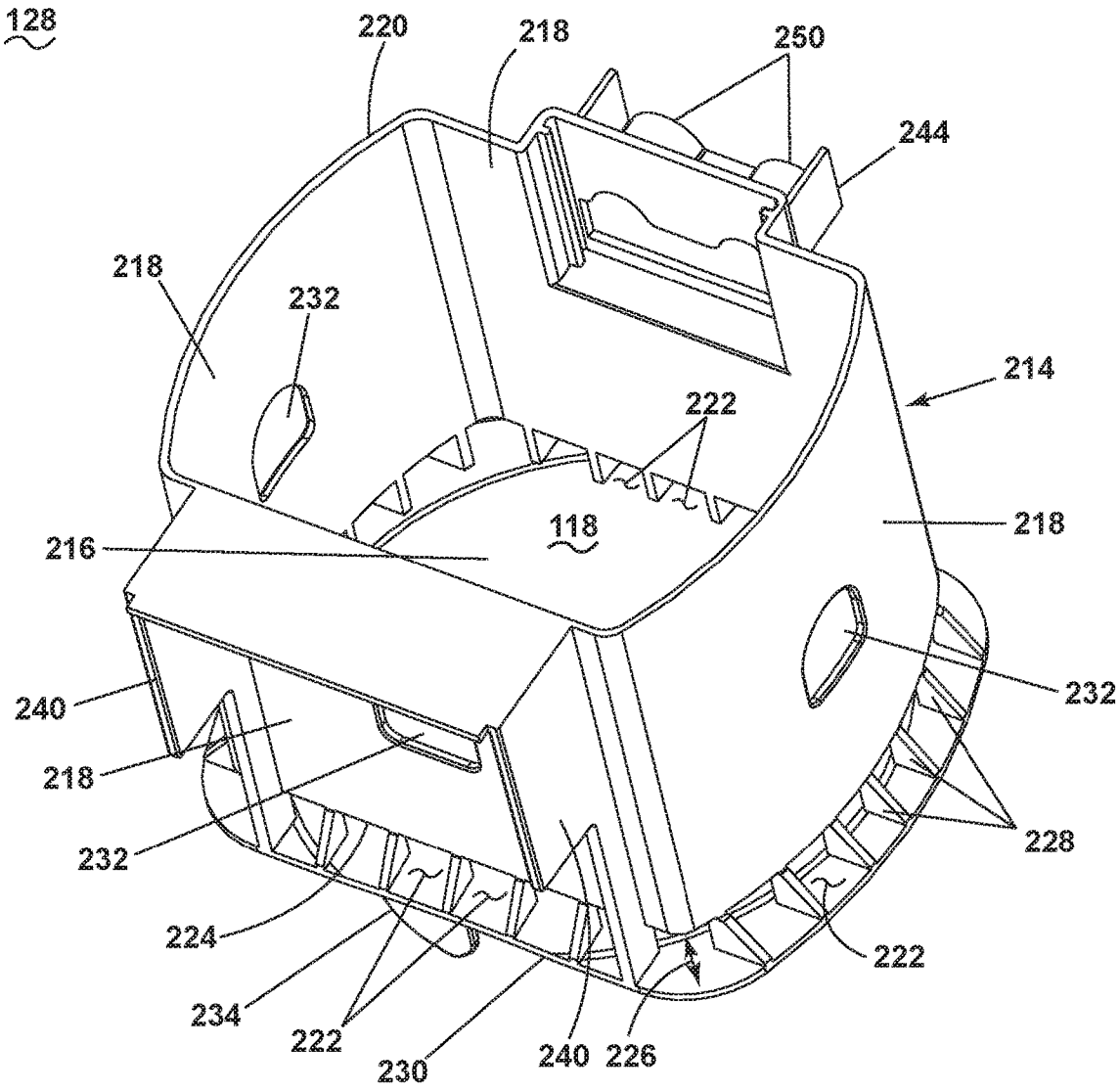
FIG. 12 is a perspective view of a main-wash insert of the dispenser.

FIG. 12 is a perspective view of the main-wash insert 128. The main-wash insert 128 is a receptacle or cup that is configured to hold a dose of powder treating chemistry, such as a powder detergent. The insert 128 includes an open-topped cup 214 having a base wall 216 and side walls 218 extending upwardly from the base wall 216 to define a peripheral wall of the cup 214 having an open top defining an insert opening 220 into the interior of the cup 214. The cup 214 can be generally rectilinear in shape, with four side walls 218 defining the peripheral wall.

The cup 214 further comprises a plurality of outlets 222 defined between the base wall 216 and the side wall 218. As shown herein, the outlets 222 are defined between a bottom edge 224 of the peripheral side wall 218 and the base wall 216. The side walls 218 are coupled with the base wall 216 by a standoff to form a clearance gap 226 therebetween. The clearance gap 226 acts as a drain for the chemistry and water mixture in the insert 128. The standoff may comprise a plurality of spaced ribs 228 joining the bottom edge 224 of the side walls 218 to the base wall 216, and which defines the plurality of peripheral outlets 222 for the insert 128. The ribs 228 provide structural rigidity and also acts as a coin trap to prevent objects larger than the space between the ribs 228 from being dispensed into the washing machine. In one non-limiting example, the clearance gap 226 can have a height of approximately 10 mm, and the distance between adjacent ribs 228 can be approximately 10 mm.

The clearance gap 226 can be configured to reduce turbulence and splashing of water. The ribs 228 can be configured to direct water flow outwardly toward the periphery of the base wall 216 to further reduce splashing. As show, the ribs 228 can be elongated in a direction toward a peripheral edge 230 of the base wall 216.

At least one overflow opening 232 can be provided in one or more of the side walls 218 to prevent the pocket 118 from being over-filled with treating chemistry. The cup 214 can be configured to hold a single dose of treating chemistry sufficient for one cycle of operation. Excess treating chemistry loaded into the pocket 118 will flow out of the overflow openings 232 and into the housing 110, where the excess treating chemistry will be washed out during the initial filling and/or pre-washing phases of the cycle.

A shield 234 can be provided on the bottom of the insert 128, and can project downwardly below the base wall 216. As further shown in FIG. 8, the shield 234 can face the pre-wash pocket 116 and prevents large objects from moving toward the outlet 144 of the housing 110 if one is introduced into the pre-wash pocket 116. The shield 234 holds large objects near the loading opening 170 for the pre-wash pocket 116 so that it can easily be removed.

Figure 13:
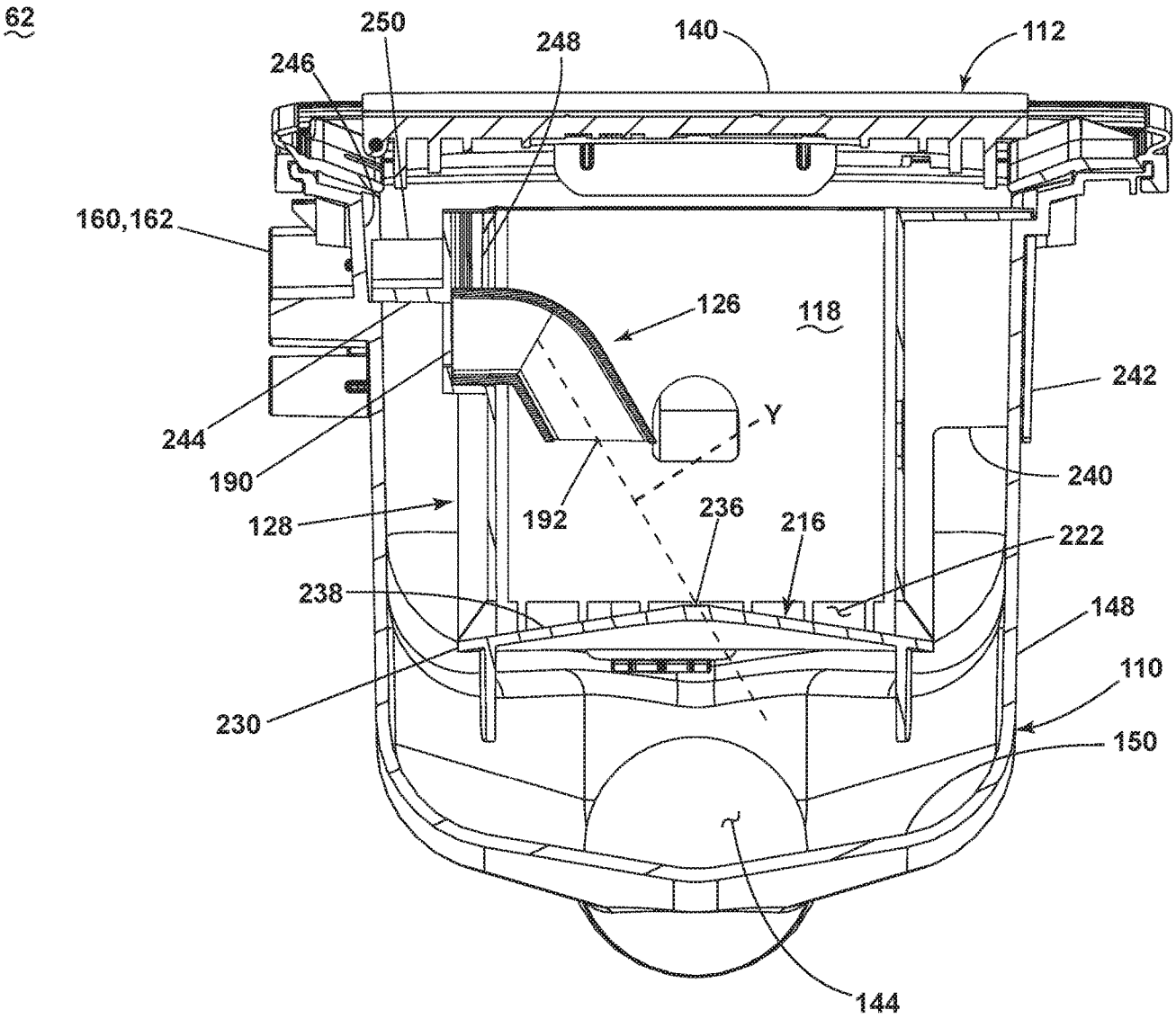
FIG. 13 is a sectional view taken along line XIII-XIII of FIG. 4, showing the flow path through a main-wash pocket of the dispenser.

FIG. 13 is a sectional view of the main-wash pocket 118 of the dispenser 62, taken through line XIII-XIII of FIG. 4. The base wall 216 is domed or conical in profile to distribute water inside the pocket 118 to achieve complete chemistry cleanout by promoting equal water flow to all areas of the pocket 118. In the case of powder treating chemistry, the base wall 216 also encourages a conical pyramid of powder to form in the insert when powder treating chemistry is loaded into the pocket 118. As shown, the upper surface of the base wall 216 includes a conical dome with an apex 236 and a surrounding peripheral surface 238 about the apex 236. The apex 236 can be pointed or rounded in shape, or, as in the illustrated embodiment, comprise a flat central surface of the base wall 216. The peripheral surface 238 surrounding the apex 236 can be generally conical or straight as shown, or may be convexly curved. The apex 236 of the domed base wall 216 can be located in the center of the pocket 118 to help distribute water inside the pocket 118 to achieve complete chemistry cleanout by promoting equal water flow to all areas of the pocket 118. In one non-limiting example, the angle of the peripheral surface 238 can be approximately 9°.

The peripheral surface 238 can extend to the peripheral edge 230 of the base wall 216, which can be located outwardly of the side walls 218, relative to the apex 236. As such, the outlets 222 can be located inwardly of the peripheral edge 230. This extension of the base wall 216 beyond the side walls 218 can further ensure that powder treating chemistry loaded into the pocket 118 remains inside the insert 128 and does not flow directly out of the insert when poured into the pocket 118. The chemistry and water mixture dispensed from the pocket 118 flows through the outlets 222 and along the bottom wall 150 of the housing 110 to the outlet 144.

Water is supplied to the interior of the insert 128 by the water inlet duct 126. In the illustrated embodiment, the water inlet end 190 of the water inlet duct 126 is provided on one for the side walls 218 of the main-wash insert 128, in alignment with the hot and cold water inlets 160, 162, and the water outlet end 192 projects into the interior of the pocket 118. The water outlet end 192 can be spaced from and faces the base wall 216 of the insert 128 to dispense water toward the domed base wall 216. The flow path for dispensing treating chemistry from the main-wash pocket 118 extends from the inlet end 190, through the inlet duct 126, outwardly along domed base wall 216 to the outlets 222, along the bottom wall 150 of the dispenser container, which is spaced from and below the domed base wall 216, and to the dispenser outlet 144.

The angle of the water inlet duct 126 can selected to achieve a complete cleanout of the pocket 118, and is configured to direct water into all areas of the pocket 118 to flush the treating chemistry effectively and completely. The angle of the inlet ducts 124, 126 for the pockets 116, 118 may be the same, as illustrated, or different to ensure complete washout of each pocket. As noted above, the insert 128 forms the receptacle for treating chemistry loaded into the main-wash pocket 118, with treating chemistry loaded through the loading opening 172 falling to the base wall 216 of the insert 128. The outlet end 192 can be provided in opposition to the base wall 216 that water from the inlet duct 126 is directed at the base wall 216 to flush treating chemistry through the peripheral outlets 222. The angled portion 204 of the water inlet duct 126 prevents backflow.

For the main-wash pocket 118, the inlet duct 126 is configured such that water strikes near the center apex 236 of the domed base wall 216 to provide complete water coverage of the inside of the pocket 118 and encourage water to flow outwardly to all of the outlets 222. For example, the outlet axis Y defined by the outlet end 192 can intersect the apex 236 of the domed base wall 216.

Also in the illustrated embodiment, the inlet duct 126 can be positioned below the partition insert 114, such that the inlet duct 126 is below the loading opening 172 for the pocket 118. The angle of the inlet duct 126 can further discourage treating chemistry loaded into the pocket 118 from collecting on the inlet duct 126. With the inlet duct 126 being angled, the inlet duct 126 can advantageously be vertically offset relative to the apex 236 of the domed base wall 216, such that the pocket 118 is substantially unobstructed by the inlet duct 126 to allow for treating chemistry loaded into the pocket 118 to fall to the base wall 216, rather than collect on the inlet duct 126.

In operation, treating chemistry is poured into the pocket 118 to a level below the overflow openings 232. During a cycle of operation, water is supplied to the pocket 118 via the hot and/or cold inlets 160, 162. The incoming stream of water is directed downwardly toward the apex 236 of the domed base wall 216 by the inlet duct 126 to mix with the treating chemistry. The mixture of treating chemistry and water flows through the outlets 222 and reaches the bottom wall 150 of the housing 110, which directs the mixture toward the dispenser outlet 144.

It is noted that while the insert 128 is configured to hold and dispense powder treating chemistry, liquid treating chemistry can also be loaded into and dispensed from the main-wash pocket 118. The insert 128 can receive a dose of liquid treating chemistry, but the liquid may flow directly into the housing 110 without being held within the cup. It is also noted that while the main-wash pocket 118 is formed by a separate insert 128, the features of the insert 128 defining the main-wash pocket 118 can also be partially or fully integrated with other components of the dispenser 62, such as with the housing 110 or the partition insert 114.

With reference to FIGS. 5, 12, and 13, the main-wash insert 128 can further include mounting features for holding the insert 128 in place within the dispenser housing 110. In the illustrated embodiment, the insert 128 includes a sliding interface with the housing 110, with first extensions 240 on one side wall 218 of the insert 128 received in corresponding grooves 242 provided on a front portion of the housing 110, and a second extension 244 on an opposite side wall of the insert 128 received in a corresponding holder 246 on a rear portion of the housing 110. The main-wash insert 128 can further be held in position by a rib 248 on the partition insert 114. The rib 248 extends downwardly and engages the top of the water inlet duct 126. The second extension 244 can include conduit extensions 250 which fluidly couple with the hot and cold water inlets 160, 162 for the main-wash pocket 118.

Figure 14:
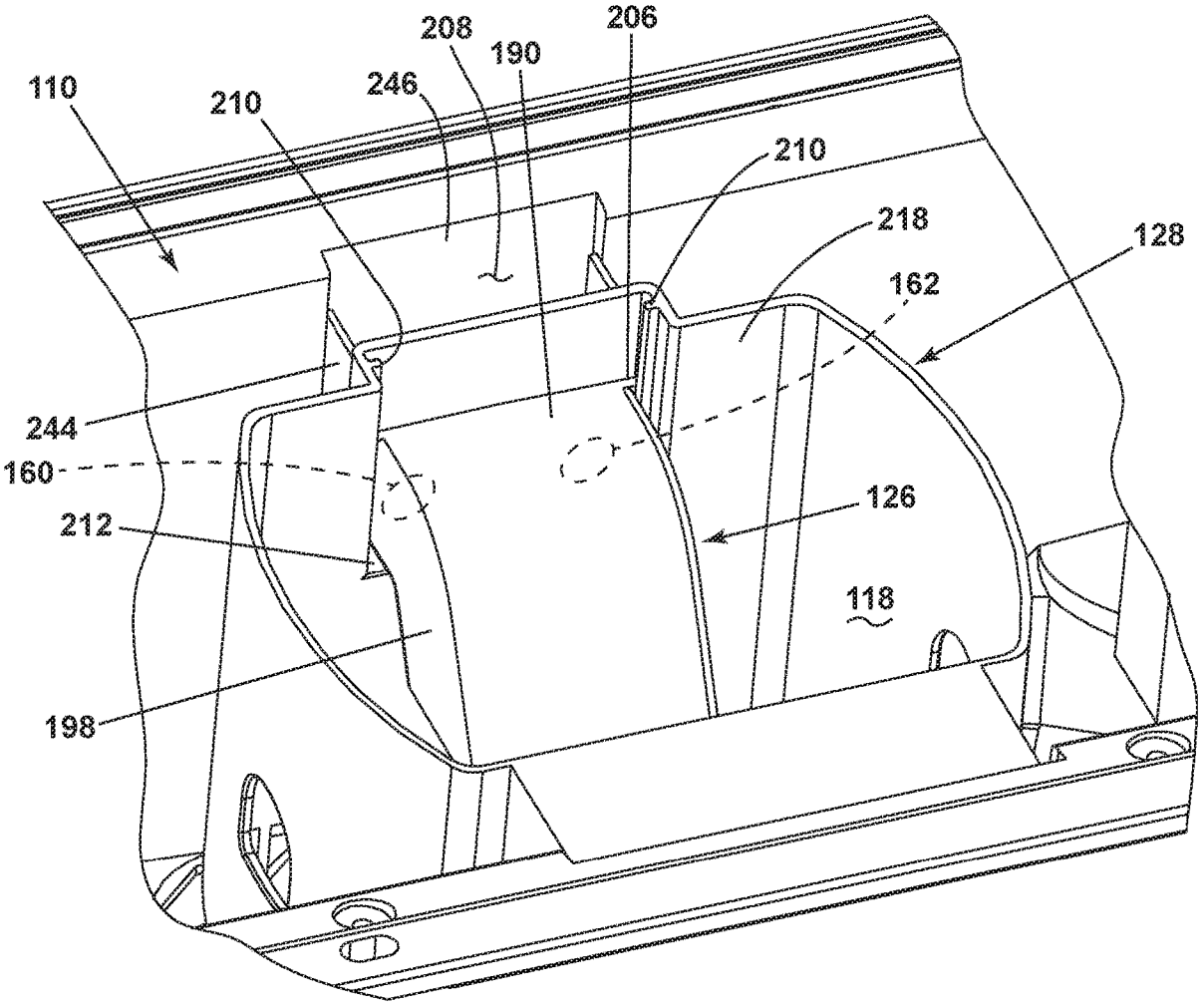
FIG. 14 is a close up view of an interface between the water inlet duct of the main-wash pocket and the dispenser.

FIG. 14 is a close up view of an interface between the water inlet duct 126 and the main-wash insert 128. The dispenser housing 110 is also shown for reference. The water inlet duct 126 can be coupled with the housing 110 indirectly by the main-wash insert 128, which is directly coupled with the housing 110. In the illustrated embodiment, the water inlet end 190 is slidingly coupled with the side wall 218 of the insert 128. The sliding interface can be identical to that sliding interface previously described, with rails 206 projecting from the water inlet end 190 of the water inlet duct 126 and a track 208 configured to receive the rails 206 provided on the side wall 218 of the insert 128. Alternatively, the rails 206 can be provided on the insert 128, and the track 208 can be provided on the water inlet duct 126. Other configurations for the sliding interface are also possible.

In the illustrated embodiment, rails 206 project from the side walls 198 of the water inlet duct 126. The rails 206 are received within the track 208 and held behind ribs 210 on the sides of the track 208. The inlet duct 126 rests on a bottom wall 212 of the track 208. The conduit extensions 250 are aligned with the track 208 to fluidly couple with the inlet end 190 of the inlet duct 126 with the hot and cold water inlets 160, 162 when the inlet duct 126 is physically coupled with the insert 128 and the insert is physically coupled with the dispenser housing 110.

Figure 15:
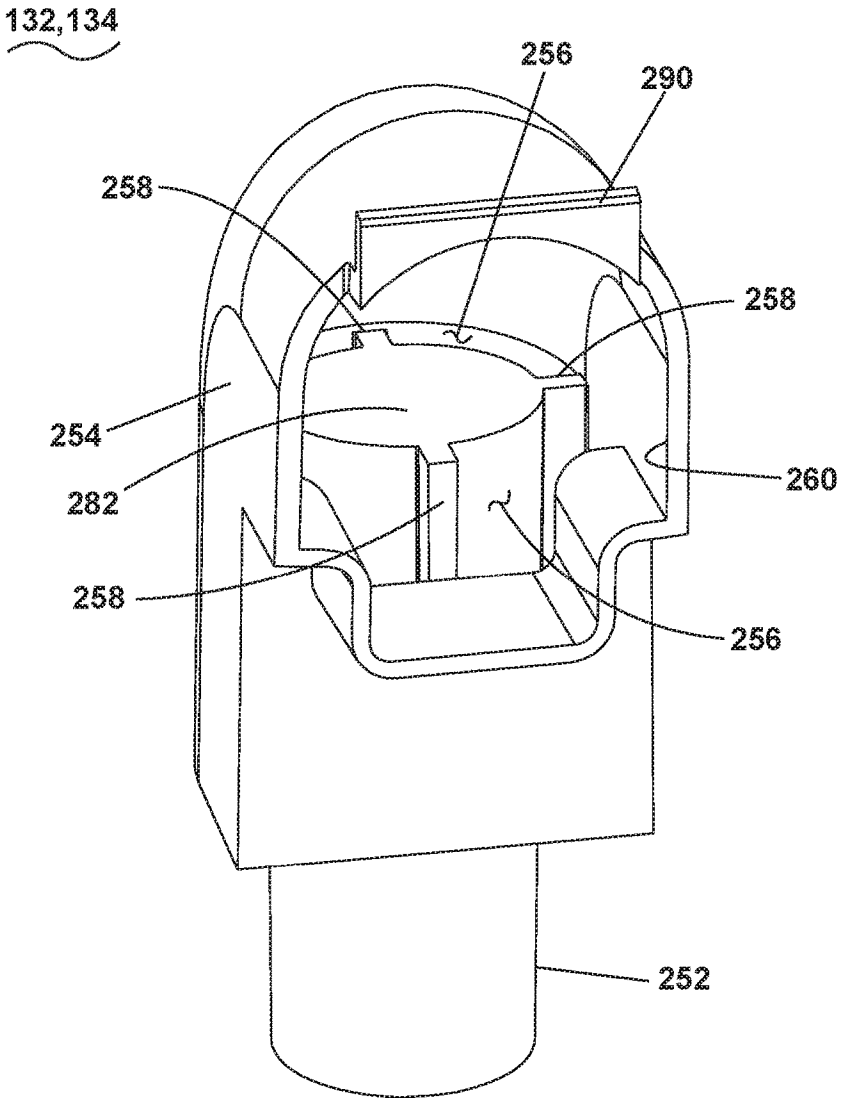
FIG. 15 is a rear perspective view of a siphon of the dispenser.

FIG. 15 is a rear perspective view of the siphons 132, 134 of the dispenser. The siphons 132, 134 comprises siphon ducts that are configured to create a water siphon inside the bleach and fabric softener pockets 120, 122 to help chemistry cleanout. The siphons 132, 134 mix treating chemistry with water to form a water/chemistry mixture that can then be directed into the treating chamber of the washing machine 10. The siphons 132, 134 can be identical, and include an inner siphon tube 252 and an outer cover tube 254 surrounding the siphon tube. The siphon 132 includes an annulus 256 between the siphon tube 252 and the cover tube 254. A standoff can connect the cover tube 254 with the siphon tube 252 in a spaced relationship to form the annulus 256. In the illustrated embodiment, the standoff can include a plurality of ribs 258 joining the cover tube 254 with the siphon tube 252.

Figure 16:
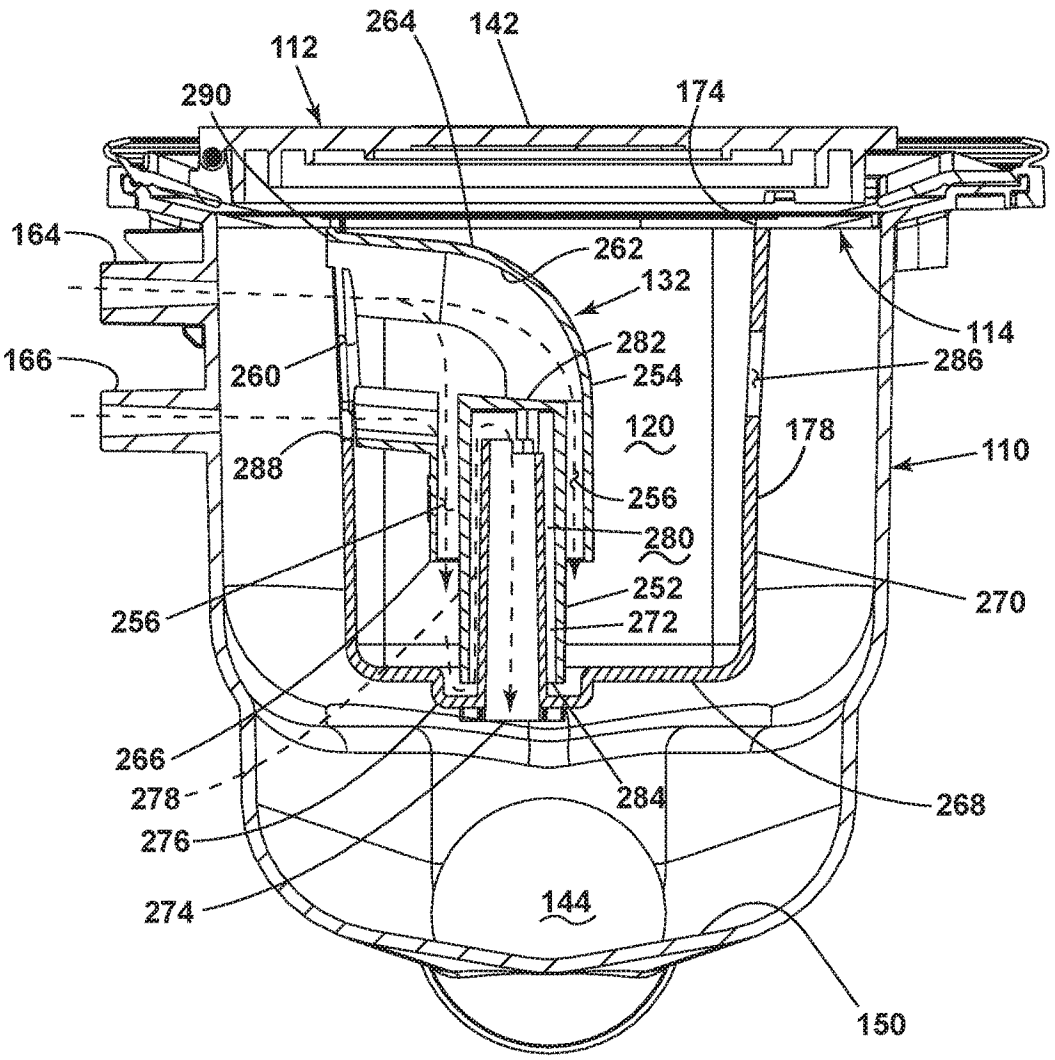
FIG. 16 is a sectional view taken along line XVI-XVI of FIG. 4, showing the water flow path through a bleach pocket of the dispenser.

FIG. 16 is a sectional view taken along line XVI-XVI of FIG. 4, showing the water flow path through the bleach pocket 120 of the dispenser 62. The configuration of the siphons 132, 134 and the pocket bodies 178, 180 the bleach and fabric softener pockets 120, 122 may be similar to construction and operation, as in the illustrated embodiment. As such, only one siphon and pocket is described in detail herein, and the structural details and operation of the bleach pocket 120 described herein is understood to apply to the fabric softener pocket 122 as well. However it is understood that the configuration of the bleach and fabric softener pockets 120, 122 may also differ.

The outer cover tube 254 acts as a channel to bring water from the hot and cold water inlets 164, 166 located on the dispenser housing 110 into the pocket 120 via the annulus 256. The cover tube 254 includes an inlet-side opening 260 that receives water. The inlet-side opening 260 can be shaped to align with the hot and cold water inlets 164, 166 such that the siphon 132 can receive water from either inlet 164, 166. For directing water from the inlet-side opening 260 to the annulus 256, the cover tube 254 has a domed-shaped inner surface 262 facing the opening 260. The outer surface of the cover tube 254 can also be domed-shaped, with a sloped top surface 264 to prevent treating chemistry residue from forming on the top of the siphon 132. The cover tube 254 extends downwardly from the dome-shaped inner surface 262 to an open lower end 266 that the spaced from the siphon tube 252, such that the annulus 256 does not extend the full length of the siphon tube 252.

The pocket body 178 is a receptacle or cup that is configured to hold a dose of liquid treating chemistry, such as bleach in the case of the bleach pocket 120 shown in FIG. 16. The pocket body 178 includes a base wall 268 and side walls 270 extending upwardly from the base wall 268 to define a peripheral wall of the pocket 120 having an open top aligned with the loading opening 174. An upstanding siphoning conduit 272 is supported by the body 178, and fluidly communicates with an opening in the base wall 268 defining a pocket outlet 274. The cover tube 254 and siphon tube 252 are supported in an overlying relationship to the siphoning conduit 272.

A pocket sump 276 is formed as a recessed area in the base wall 268, and surrounds the siphoning conduit 272. The open bottom of the siphon tube 252 is spaced from the pocket sump 276 to allow liquid in the pocket 120 to be drawn up into a siphoning pathway 278 to the pocket outlet 274. The siphoning pathway 278 is defined by an annulus 280 between the siphon tube 254 and the siphoning conduit 272 and by the interior space within the siphoning conduit 272. The inner siphon tube 252 has a close top or cap 282 at an upper end of the siphon tube 252 which directs the mixture from the annulus 280 to the interior of the siphoning conduit 272, and an open bottom forming an inlet 284 to the siphoning pathway 278 for the water/chemistry mixture.

At least one overflow opening 286 can be provided in one or more of the side walls 270 to prevent the pocket 120 from being over-filled with treating chemistry. The pocket body 178 can be configured to hold a single dose of treating chemistry sufficient for one cycle of operation. Excess treating chemistry loaded into the pocket 120 will flow out of the overflow opening 286 and into the dispenser housing 110, where the excess treating chemistry will be washed out during the initial filling and/or pre-washing phases of the cycle.

The siphon 132 can be formed as a separate component from the pocket body 178, and can be inserted into the pocket body 178 with the siphon tube 252 received on the siphoning conduit 272 and the inlet-side opening 260 aligned with a corresponding siphon opening 288 in the side wall 270 of the pocket body 178 that faces the hot and cold water inlets 164, 166. In the illustrated embodiment, a rib 290 on the cover tube 254 can interface with an edge of the siphon opening 288 opening in the pocket body 178 to hold the siphon 132 in place, along with the concentric tube 252 and the siphoning conduit 272. Other interfaces between the siphon 132 and pocket 120 are possible.

The water flow path through the siphon 132 is presented by arrows in FIG. 16. In operation, treating chemistry is poured into the pocket 120 to a level below the overflow opening. During a cycle of operation, water is supplied to the pocket 120 via the hot and/or cold inlets 164, 166. The incoming stream of water is directed downwardly by the cover tube 254 and through the annulus 256 to the pocket body 178 to mix with the treating chemistry, while raising the liquid level. Once the liquid level rises above the top of the siphoning conduit 272, the mixture both overflows through the overflow opening 286 and enters the top of the siphoning conduit 272. The mixture that enters the siphoning conduit 272 is directed into the dispenser housing 110 via the pocket outlet 274. The mixture reaches the bottom wall 150 of the housing 110, which directs the mixture toward the dispenser outlet 144.

Figure 17:
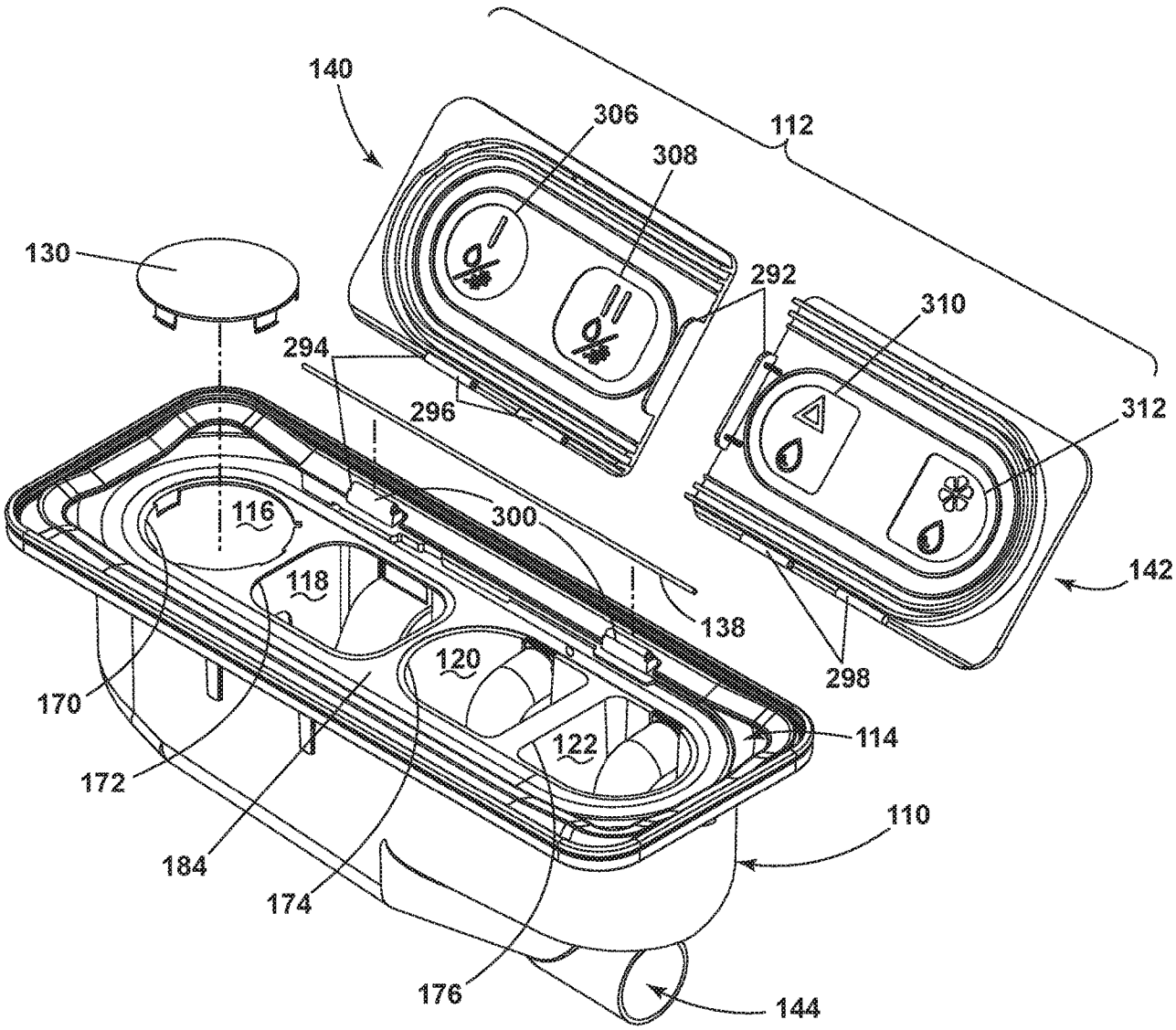
FIG. 17 is a partially-exploded view of the dispenser of FIG. 4, showing a cover of the dispenser.

FIG. 17 is a partially-exploded view of the dispenser 62, illustrating features of the dispenser cover 112 of the dispenser 62. The primary function of the dispenser cover 112 is to cover the loading openings 170-176 of the pockets 116-122 and avoid splashing water outside the dispenser 62. The dispenser cover 112 is a split lid to distinguish "powder" and "liquid" sections of the dispenser 62. The cover 112 shown includes the first lid 140 which covers the pre-wash and main-wash pockets 116, 118 and the second lid 142 which covers the bleach and fabric softener pockets 120, 122.

The powder chemistry pockets 116, 118 are arranged in a first group and the multiple liquid chemistry pockets 120, 122 are arranged in a second group. The lids 140, 142 are associated with one group, and cover all pockets of its associate group. The first and second groups of pockets can be linearly arranged, with the first and second lids 140, 142 are arranged in side-by-side juxtaposition with each other on the dispenser housing 110. When closed (see, for example, FIGS. 3-4), the lids 140, 142 are flush with each other provide a substantially continuous upper surface for the dispenser 62.

The lids 140, 142 can have standoffs 292 that come into contact with the partition insert 114 when the lids 140, 142 is closed to provide a more robust enclosure. Since the inner area 184 of the partition insert 114 is recessed, the standoffs 292 support the inner area of the lids 140, 142 when closed and ensure that the lids 140, 142 do not sag or become misaligned over time.

The dispenser cover 112 is coupled with the partition insert 114 of the dispenser container 108 by a hinge coupling that includes the hinge pin 138 and a hinge barrel 294 which receives the hinge pin 138. The hinge pin 138 acts as a constraint for the lids 140, 142 and defines an axis about which each lid 140, 142 rotates. The dispenser 62 uses a single hinge pin 138 for both lids 140, 142, but still allows the user to open one lid at a time.

The hinge barrel 294 is formed by multiple knuckles on the partition insert 114 and the cover 112. As shown, the dispenser cover 112 includes two lids 140, 142 and two knuckles 296, 298 are provided on each lid 140, 142, respectively. Two spaced knuckles 300 are provided on the partition insert 114, with the lid-side knuckles 296, 298 on either side of and aligned with the container-side knuckles 300 to define the hinge barrel 294. The hinge coupling is preferably on the rear side of the dispenser 62, away from the front of the washing machine 10 (see FIG. 3), so that the cover 112 opens away from the front of the dispenser 62 for convenient loading.

Each lid 140, 142 has an interface with the hinge pin 138 defined by the lid-side knuckles 296, 298. The interface between the hinge pin 138 and the lid-side knuckles 296, 298 may be different on each lid 140, 142 in order to allow the lids 140, 142 to open individually, while still using one hinge pin 138. For example, a clearance fit is provided between the lid-side knuckles 296 on the powder section lid 140 and the hinge pin 138 to allow the powder section lid 140 to rotate freely about the hinge pin 138 as the lid 140 is opened or closed, while an interference fit is provided between the lid-side knuckles 298 on the liquid section lid 142 and the hinge pin 138 causes the hinge pin 138 to rotate along with the liquid section lid 142 as the lid 142 is opened or closed. In another embodiment, the powder section lid 140 can be provided with the interference fit and the liquid section lid 142 can be provided with the clearance fit. A clearance fit may also be provided between the container-side knuckles 300 on the partition insert 114 and the hinge pin 138 to allow the hinge pin 138 to rotate freely relative to the partition insert 114, regardless of which lid 140, 142 is being opened, to allow the lids 140, 142 to open one at a time or at the same time.

Figure 18:
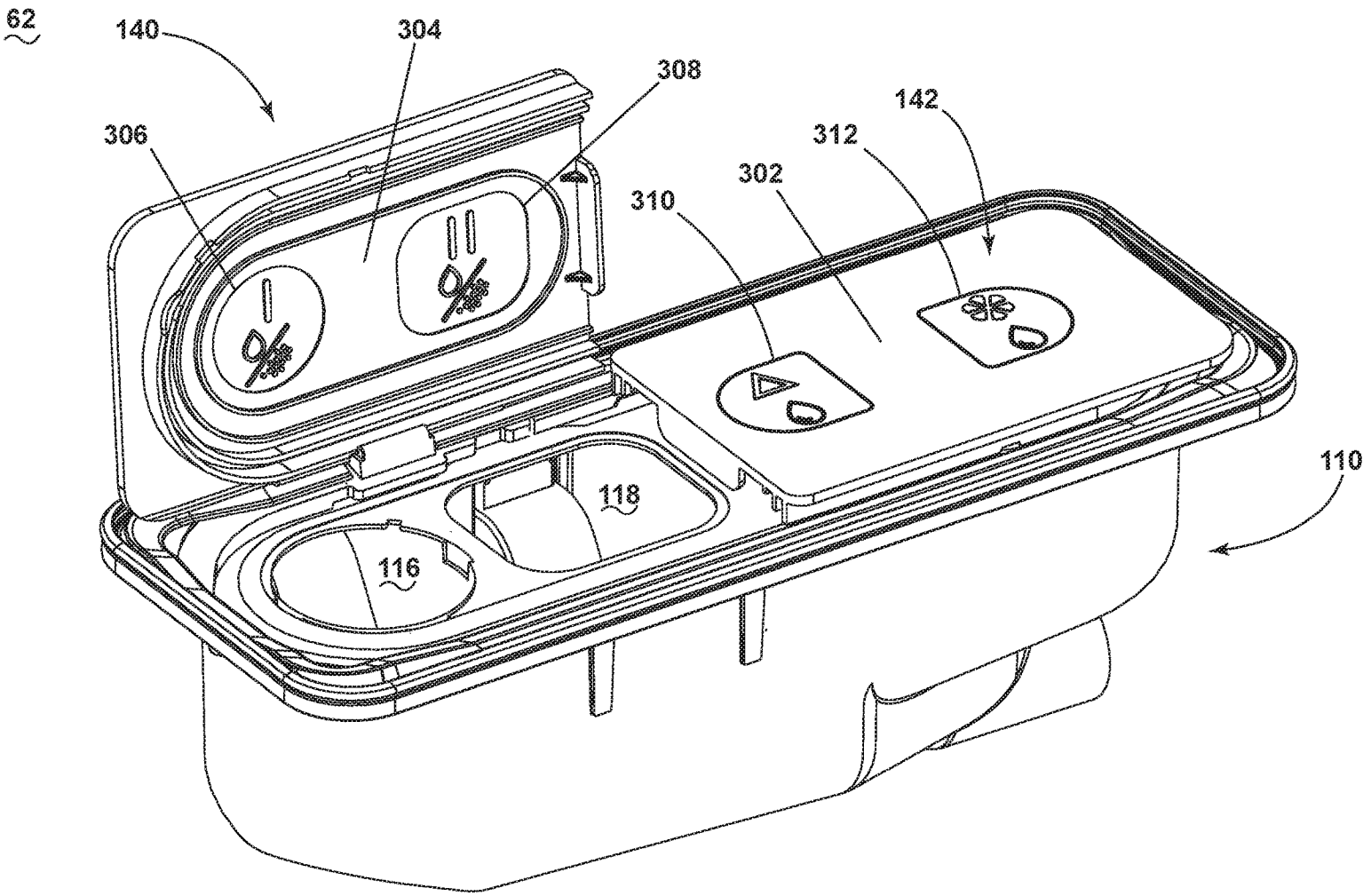
FIG. 18 is a front perspective view of the dispenser of FIG. 4, showing a first lid of the cover in an open position and a second lid of the cover in a closed position.
Figure 19:
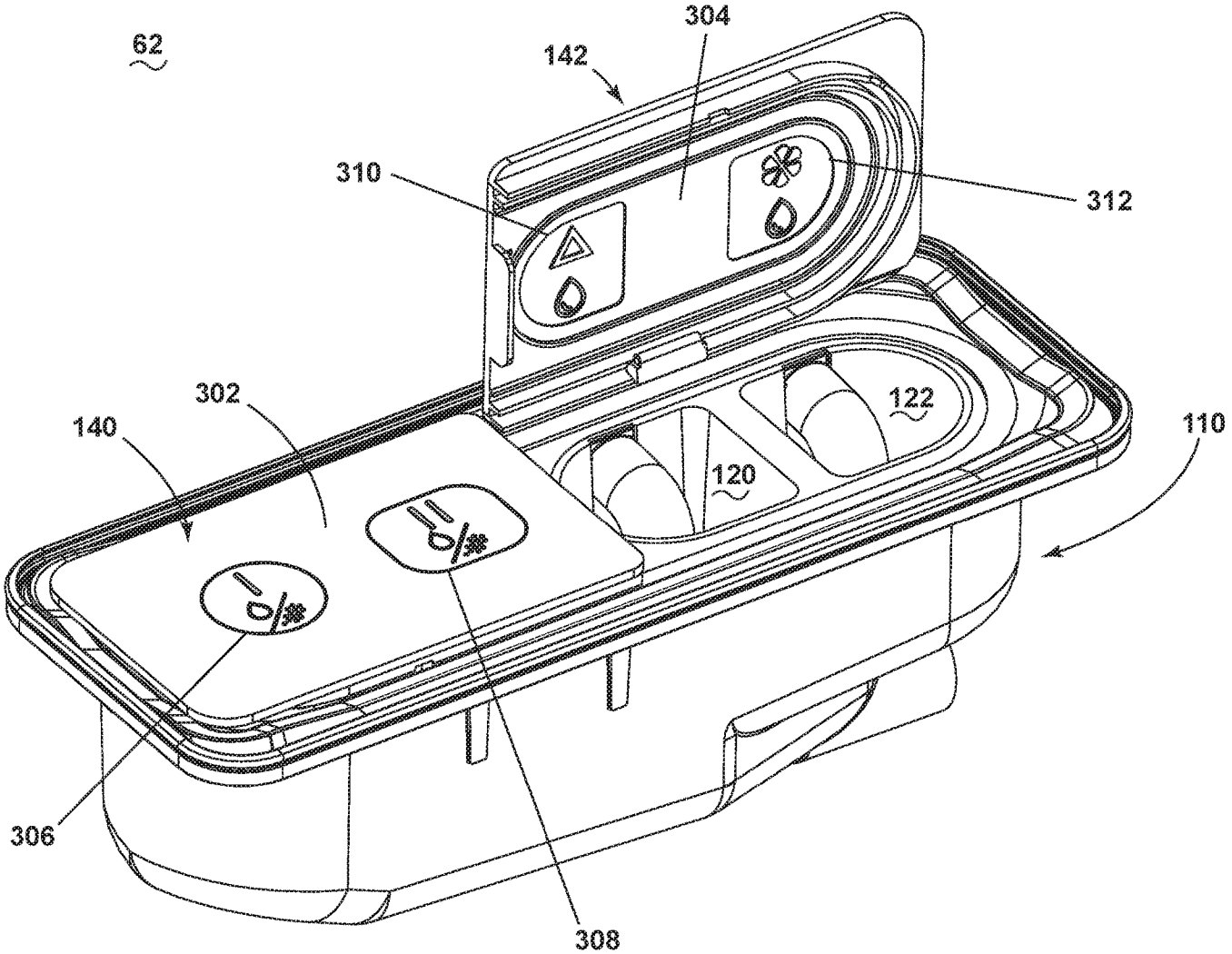
FIG. 19 is a front perspective view of the dispenser of FIG. 4, showing a first lid of the cover in a closed position and a second lid of the cover in an open position.

FIG. 18 is a front perspective view of the dispenser 62, showing the powder section lid 140 in an open position and the liquid section lid 142 in a closed position. In this position, treating chemistry can be loaded into the pre-wash and main-wash pockets 116, 118. FIG. 19 is a front perspective view of the dispenser 62, showing the powder section lid 140 in a closed position and liquid section lid 142 in an open position. In this position, treating chemistry can be loaded into the bleach and fabric softener pockets 120, 122.

Markings or indicia 306-312 can be provided on the lids 140, 142 to indicate what types of treating chemistry should be loaded into each pocket 116-122. Advantageously, the present embodiment has markings on both outer and inner surfaces 302, 304 of the lids 140, 142, the outer surface 302 being the side of the lids 140, 142 that is visible from the exterior of the dispenser 62 when the lids 140, 142 are closed and the inner surface 304 being the side of the lids 140, 142 that faces the pockets 116-122 and that is not visible when the lids 140, 142 are closed.

As shown herein, the indicia 306-312 include an individual or unique marking for each pocket 116-122. Each indicia can be a two-part icon indicating two pieces of information to the user. The two-part icon can include an upper symbol which indicates the category of treating chemistry which should be loaded in each pocket 116-122, and corresponds to the portion of the cycle in which the treating chemistry will be dispensed. As shown herein, the pre-wash pocket 116 includes an "I" or "one" symbol in the indicia 306 indicating that the pocket 116 is for pre-wash detergent, the main-wash pocket 118 includes a "II" or "two" symbol in the indicia 308 indicating the pocket 118 is for main wash detergent, the bleach pocket 120 includes a triangle symbol in the indicia 310 indicating that the pocket 120 is for bleach, and the fabric softener pocket 122 includes a flower symbol in the indicia 312 indicating that the pocket 122 is for fabric softener.

The two-part icon can further include a lower symbol which indicates the form of treating chemistry which should be loaded into each pocket 116-118, such as powder or liquid. For example, powder may be indicated by a granule and liquid may be indicated by a raindrop or teardrop symbol. As shown herein, the pre-wash and main-wash pockets 116, 118 includes a liquid and powder symbol in the indicia 306, 308, indicating that either form of treating chemistry should be loaded therein, and the bleach and fabric-softener pockets 120, 122 have a liquid symbol in the indicia 310, 312, indicating that liquid treating chemistry should be loaded therein. It is noted that the term "liquid" as used herein with respect to a form of treating chemistry includes gel-based treating chemistries.

The indicia 306-312 can further include an outline around each two-art icon that mimics the shape of the corresponding loading opening 170-176 in the partition insert 114, further drawing a visual parallel between the indicia 306-312 and the pockets 116-122. In the embodiment illustrated herein, the indicia 306 for the pre-wash pocket 116 can have a circular outline, the indicia 308 for the main-wash pocket 118 can have a rectangular outline, the indicia 310 for the bleach pocket 120 can have a left-facing D-shaped outline, and the indicia 312 for the fabric softener pocket 122 can have a right-facing D-shaped outline.

The treating chemistry dispenser 62 disclosed herein provides an improved dispenser for commercial and household washing machines. Available dispensers for washing machines, including commercial washing machines, may not completely wash out the treating chemistry in the dispensing compartments, which impacts cleaning performance. This is observed for both powder and liquid chemistries. The lack of complete chemistry cleanout also results in a residue inside the dispenser, which is poorly perceived by users, particularly customers utilizing commercial machines.

The dispenser of the present embodiment improves the performance of such dispensers by providing a water inlet duct configured to completely wash out the dispensing compartments. The innovative water inlet solution provides improved water distribution into the dispensing compartments and provides a better chemistry cleanout performance. In particular, the water inlet ducts 124, 126 are configured to improve water distribution and drive better chemistry cleanout performance for the pre-wash and main-wash pockets 116, 118. The water inlet ducts 124, 126 define a water inlet channel from water inlets on the dispenser container to the interior of their respective pockets and are configured to direct water to achieve complete (100%) chemistry cleanout. A sliding interface for the water inlet ducts 124, 126 may be preferred because such an interface ensures easy assembly and a robust interface, even in cases of high water pressure. The configuration of the inlet ducts 124, 126 and location of the interface with the dispenser container allows water to flow at a higher velocity to flush treating chemistry out of the pockets, and in the case of powder treating chemistry, avoid forming lumps of powder in the pockets.

The innovative design of the main-wash pocket 118 also provides easy loading of treating chemistry into the pocket 118, at the volume required for each cycle, and also drives a better chemistry cleanout performance by using a domed base wall to evenly distribute water to all areas of the pocket 118.

Yet another advantage that may be realized in the practice of some embodiments of the described treating chemistry dispenser 62 is that the innovative design of the siphons 132, 134 also drives a better chemistry cleanout performance for the liquid compartments. The outer surface of the siphons 132 134 can also be domed-shaped with a sloped top surface to prevent treating chemistry residue from forming on the siphon.

Yet another advantage that may be realized in the practice of some embodiments of the described treating chemistry dispenser 62 is that the cover 112 provides clear instructions on how to load the dispenser 62 via the split-lid design and indicia. Available dispensers in the commercial laundry segment lack distinguishing features to differentiate powder and liquid chemistry chambers, making it difficult for a first-time user or a sporadic user of the appliance to figure out how to properly load the dispenser. The dispenser 62 of the present disclosure improves chemistry loading by having separate lids 140, 142 covering the powder and liquid sections of the dispenser 62. The hinged design of the lids allow just one of the lids to be open at a time. The dispenser 62 of the present disclosure also improves usability by visually differentiating between powder and liquid compartments using icons on both the inside and outside of the cover.

To the extent not already described, the different features and structures of the treating chemistry dispenser 62 may be used in combination with each other as desired. That all features are illustrated in a single embodiment of the treating chemistry dispenser 62 is not meant to be construed that they must be, but is done for brevity of description. Thus, the various features and structures of the treating chemistry dispenser 62 may be mixed and matched as desired to form new embodiments, whether or not the new embodiments are expressly described. Furthermore, although the embodiment of the treating chemistry dispenser 62 has been shown and described relative to a multi-compartment, single dose dispenser, the different features and structures of the treating chemistry dispenser 62 may be used in single compartment dispensers or bulk dispensers.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance comprising:
- a cabinet comprising a treating chamber;
- a treating chemistry dispenser provided with the cabinet and fluidly coupled to the treating chamber, the treating chemistry dispenser comprising at least one dispenser pocket having:
  - an upwardly extending side wall defining an open top of the at least one dispenser pocket;
  - a domed base wall defining a bottom of the at least one dispenser pocket and extending into the at least one dispenser pocket; and
  - a plurality of outlets provided at a junction of the domed base wall and the side wall.

2. The laundry treating appliance of claim 1, wherein the domed base wall comprises a central apex and a peripheral surface about the central apex.

3. The laundry treating appliance of claim 2, wherein the peripheral surface comprises a peripheral edge located outwardly of the side wall relative to the central apex.

4. The laundry treating appliance of claim 1, wherein the side wall comprises a peripheral side wall upwardly from the domed base wall and defining an interior compartment of the at least one dispenser pocket for receiving a dose of treating chemistry.

5. The laundry treating appliance of claim 4, wherein the plurality of outlets are defined between a bottom edge of the peripheral side wall and the domed base wall.

6. The laundry treating appliance of claim 1, further comprising ribs connecting the domed base wall to the side wall, wherein the plurality of outlets are defined by the ribs.

7. The laundry treating appliance of claim 1, and further comprising a standoff between a lower end of the side wall and the domed base wall providing a clearance gap therebetween, wherein the plurality of outlets are provided at the clearance gap.

8. The laundry treating appliance of claim 7, wherein the standoff comprises a plurality of ribs between the side wall and the domed base wall, wherein the plurality of outlets are defined between the plurality of ribs.

9. The laundry treating appliance of claim 1, and further comprising a water inlet duct having a water inlet end and a water outlet end projecting into an interior the at least one dispenser pocket.

10. The laundry treating appliance of claim 9, wherein the water outlet end faces the domed base wall.

11. The laundry treating appliance of claim 10, wherein the domed base wall comprises an apex, the water outlet end defines an outlet axis, and wherein the outlet axis intersects the apex of the domed base wall.

12. The laundry treating appliance of claim 11, wherein the water inlet duct is angled between the water inlet end and the water outlet end.

13. The laundry treating appliance of claim 9, wherein the water inlet duct is angled between the water inlet end and the water outlet end.

14. The laundry treating appliance of claim 1, wherein the treating chemistry dispenser further comprises a dispenser container in which the at least one dispenser pocket is provided and a lid coupled with the dispenser container and covering the at least one dispenser pocket.

15. The laundry treating appliance of claim 14, wherein the at least one dispenser pocket comprises an insert received within the dispenser container.

16. The laundry treating appliance of claim 15, further comprising a water inlet duct configured to supply water to an interior of the at least one dispenser pocket, wherein the insert comprises an interface for receiving the water inlet duct.

17. The laundry treating appliance of claim 14, wherein the dispenser container comprises a bottom wall spaced from and below the domed base wall.

18. The laundry treating appliance of claim 17, wherein the dispenser container further comprises a dispenser outlet in fluid communication with the treating chamber, wherein the bottom wall is angled toward the dispenser outlet.

19. A laundry treating appliance comprising:

a cabinet comprising a treating chamber;

a treating chemistry dispenser provided with the cabinet and fluidly coupled to the treating chamber, the treating chemistry dispenser comprising at least one dispenser pocket having:

an upwardly extending side wall defining an open top of the at least one dispenser pocket;

a domed base wall defining a bottom of the at least one dispenser pocket and extending into the at least one dispenser pocket; and an angled inlet duct projecting into the at least one dispenser pocket and having an outlet end in opposition to the domed base wall.

20. The laundry treating appliance of claim 19, further comprising a plurality of pocket outlets provided at a periphery of the domed base wall.

* * * * *